US006720299B2

(12) United States Patent
Chapple et al.

(10) Patent No.: US 6,720,299 B2
(45) Date of Patent: Apr. 13, 2004

(54) BLEACHING COMPOSITION OF ENHANCED STABILITY AND A PROCESS FOR MAKING SUCH A COMPOSITION

(75) Inventors: Andrew Paul Chapple, Merseyside (GB); Antonius Henricus J. Strijbosch, Vlaardingen (NL)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 158 days.

(21) Appl. No.: 10/075,997

(22) Filed: Feb. 14, 2002

(65) Prior Publication Data

US 2002/0173440 A1 Nov. 21, 2002

(30) Foreign Application Priority Data

Feb. 16, 2001 (GB) ..... 0103871

(51) Int. Cl.[7] ..... C11D 3/395; C11D 3/00; C11D 7/18; C11D 7/54; C11D 17/00

(52) U.S. Cl. ..... 510/367; 510/276; 510/302; 510/441; 510/443

(58) Field of Search ..... 510/276, 302, 510/367, 441, 443

(56) References Cited

U.S. PATENT DOCUMENTS

| | | | | |
|---|---|---|---|---|
| 3,158,635 A | | 11/1964 | Kezerian et al. | |
| 3,935,257 A | | 1/1976 | Ruest et al. | |
| 3,936,448 A | | 2/1976 | Lamberti | |
| 3,956,381 A | | 5/1976 | Krause | |
| 3,956,383 A | | 5/1976 | Krause et al. | |
| 3,965,170 A | | 6/1976 | Krause | |
| 4,147,673 A | | 4/1979 | Dulog et al. | |
| 4,728,455 A | | 3/1988 | Rerek | |
| 4,985,152 A | | 1/1991 | Hilbig et al. | |
| 5,244,594 A | | 9/1993 | Favre et al. | |
| 5,356,554 A | * | 10/1994 | Delwel et al. | 252/94 |
| 5,536,441 A | * | 7/1996 | Chapple et al. | 252/186.33 |
| 6,140,294 A | | 10/2000 | Delroisse et al. | |
| 6,165,963 A | | 12/2000 | Delroisse et al. | |
| 6,242,409 B1 | | 6/2001 | Appel et al. | |
| 6,245,115 B1 | | 6/2001 | Appel et al. | |

FOREIGN PATENT DOCUMENTS

| | | |
|---|---|---|
| DE | 186 55 493 | 12/1997 |
| EP | 0 305 282 | 8/1988 |
| EP | 0 458 379 | 5/1991 |
| EP | 0 544 491 | 6/1993 |
| EP | 0 909 809 | 9/1998 |
| EP | 0 999 050 | 11/1999 |
| FR | 831.368 | 11/1975 |
| GB | 1 261 829 | 1/1972 |
| GB | 1 379 241 | 1/1975 |
| GB | 1 387 447 | 3/1975 |
| GB | 1 389 732 | 4/1975 |
| GB | 1 398 421 | 6/1975 |
| GB | 1 398 422 | 6/1975 |
| GB | 1 425 343 | 2/1976 |
| GB | 1 439 000 | 6/1976 |
| GB | 1 596 756 | 8/2001 |
| NL | 7205873 | 4/1972 |
| WO | 95/34628 | 12/1995 |
| WO | 97/48787 | 12/1997 |
| WO | 98/39098 | 9/1998 |
| WO | 98/39406 | 9/1998 |
| WO | 99/65905 | 12/1999 |
| WO | 00/12667 | 3/2000 |
| WO | 00/12808 | 3/2000 |
| WO | 00/29537 | 5/2000 |
| WO | 00/52124 | 9/2000 |
| WO | 00/60043 | 10/2000 |
| WO | 00/60044 | 10/2000 |
| WO | 00/60045 | 10/2000 |
| WO | 01/09276 | 2/2001 |

OTHER PUBLICATIONS

GB Search Report.

* cited by examiner

*Primary Examiner*—Yogendra N. Gupta
*Assistant Examiner*—John M Petruncio
(74) *Attorney, Agent, or Firm*—Milton Honig

(57) ABSTRACT

The invention relates to an air bleaching catalyst that has been coated with a polymer that serves to promote the stability of the air bleaching catalyst. The invention also provides a method of coating the air bleaching catalyst.

13 Claims, No Drawings

BLEACHING COMPOSITION OF ENHANCED STABILITY AND A PROCESS FOR MAKING SUCH A COMPOSITION

FIELD OF INVENTION

This invention relates to the stability of air bleaching in compositions.

BACKGROUND OF INVENTION

The use of bleaching catalysts for stain removal has been developed over recent years. The recent discovery that some catalysts are capable of bleaching effectively in the absence of an added peroxyl source has recently become the focus of some interest, for example: WO9965905; WO0012667; WO0012808; WO0029537, and, WO0060045.

The shelf life of a product may be regarded as the period of time over which the product may be stored whilst retaining its required quality. A satisfactory shelf life is in many instances a crucial factor for the success of a commercial product. A product with a short shelf life generally dictates that the product is made in small batches and is rapidly sold to the consumer. It is also a concern to the owners of a brand with a short shelf life that the consumer uses the product within the shelf life otherwise the consumer may be inclined to change to a similar product of another brand. In contrast a similar product with a long shelf life may be made in larger batches, held as stock for a longer period of time and the period of time that a consumer stores She product is not of a great concern to the owners of a particular brand.

It is an object of the present invention to provide an air bleaching composition that has improved storage properties.

SUMMARY OF INVENTION

We have found that the presence of an acidic component in an air bleaching composition containing a transition metal catalyst serves to enhance the stability of a transition metal catalyst in the composition.

The present invention provides an air bleaching composition having improved storage properties, for bleaching a substrate in an aqueous solution, comprising:

- particles of an air bleaching catalyst in the form of a granule comprising a transition metal complex;
- and, a component selected from the group consisting of: a cogranulent with said granule, a binder of said granule, and a coating of said granule, wherein the component is an acidic component.

The present invention further provides a process for the preparation of an air bleaching composition the air bleaching composition having improved storage properties comprising the steps of:

- optionally mixing an air bleaching catalyst with a solid cogranulant and drying to form a dry solid mixture;
- granulating the dry solid mixture with a solution of a binder material; and,
- optionally coating of the obtained granulate with a coating material,
- characterised in that least one component selected as cogranulant, binder material or coating material is acidic.

The composition of the present invention upon addition to an aqueous environment provides a solution for bleaching a substrate in which at least 10%, preferably at least 50% and optimally at least 90% of any bleaching of the substrate is effected by oxygen sourced from the air.

DETAILED DESCRIPTION OF THE INVENTION

The Acidic Component

The acidic component according to the present invention may be water-soluble acidic polymer. The polymer may be used in the compositions according to the present invention to coat, bind or act as cogranulent to the air bleaching catalyst. In a preferred embodiment of the present invention, the air bleaching catalyst, with or without cogranulant, is agglomerated, preferably with a water-soluble acidic polymer In one embodiment of the invention the binder material and the coating material are different water-soluble acidic polymers, but in another, preferred embodiment of the present invention, the binder material and the coating material are the same water-soluble acidic polymer.

In determining the scope of the present invention one skilled in the art will appreciate that a coating agent, a binder and a cogranulent may be regarded as providing overlapping functions. Nevertheless, a single function is all that is required to provide the advantage of the present invention. Obviously, if the acidic component is applied so that all three roles are fulfilled a greater stability may be conferred.

Suitable water-soluble monomeric or oligomeric carboxylate builders include lactic acid, glycolic acid and ether derivatives thereof as disclosed in Belgian Patent Nos. 831,368, 821,3609 and 821,370. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates described in German Offenlegenschrift 2,446,686, and 2,446,687 and U.S. Pat. No. 3,935,257 and the sulfinyl carboxylates described in Belgian Patent No. 840,623. Polycarboxylates containing three carboxy groups include, in particular, water-soluble citrates, aconitrates and citraconates as well as succinate derivatives such as the carboxymethyloxysuccinates described in British Patent No. 1,379,241, lacoxysuccinates described in British Patent No. 1,389,732, and aminosuccinates described in Netherlands Application 7205873, and the oxypolycarboxylate materials such is 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000.

Another preferred polycarboxylate builder is ethylenediamine-N,N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt thereof. Examples of such preferred sodium salts of EDDS include NaEDDS, Na2EDDS and Na4EDDS.

Examples of such other magnesium salts of EDDS include MgEDDS and Mg2EDDS. The magnesium salts are the most preferred for inclusion in compositions in accordance with the invention.

The structure of the acid form of EDDS is as follows:

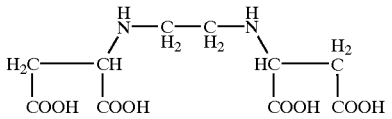

EDDS can be synthesised, for example, from readily available, inexpensive starting material such as maleic anhydride and ethylene diamine. A more complete disclosure of methods for synthesising EDDS from commercially available starting materials can be found in U.S. Pat. No. 3,158,635, Kezerian and Ramsay, issued Nov. 24, 1964.

The synthesis of EDDS from maleic anhydride and ethylene diamine yields a mixture of three optical isomers, [R,R],[S,S), and (S,R], due to the two asymmetric carbon atoms. The biodegradation of EDDS is optical isomerspecific, with the [S,S] isomer degrading most rapidly and extensively, and for this reason the (S,S) isomer is most preferred for inclusion in the compositions of the invention.

The [S,S] isomer of EDDS can be synthesised by heating L-aspartic acid and 1,2-dibromoethane in the presence of sodiun hydroxide. A more complete disclosure of the reaction of L-aspartic acid with 1,2-dibromoethane to form the (S,S) isomer of EDDS can be found in Neal and Rose, Stereospecific Ligands and Their Complexes of Ehtylenediaminediscuccinic Acid, Inorganic Chemistry, Vol 7 (1968), pp. 2405–2412.

Alicyclic and heterocyclic polycarboxylates include cyclopentane-cis,cis,cis-tetracarboxylates, cyclopentadienide pentacarboxylates, 2,3,4,5-tetrahydrofuran-cis,cis,cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1,425,343. Of the above, the preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as components of builder systems of detergent compositions in accordance with the present invention.

Other suitable water soluble organic salts are the homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 2000 to 5000 and their copolymers with maleic anhydride, such copolymers having a molecular weight of from 20,000 to 70,000, especially about 40,000.

Such builder polymeric materials may be identical to the polymeric materials as binder materials and coating materials, as described hereinabove. These materials are normally used at levels of from 0.5% to 10% by weight more preferably from 0.75% to 8%, most preferably from 1% to 6% by weight of the composition.

Organic phosphonates and amino alkylene poly (alkylene phosphonates) include alkali metal ethane 1-hydroxy diphosphonates, nitrilo trimethylene phosphonates, ethylene diamine tetra methylene phosphonates and diethylene 1,12 triamine pentamethylenephosphonates, although these materials are less preferred where the minimisation of phosphorus compounds in the compositions is desired.

Suitable polymers for use herein are water-soluble. By water-soluble, it is meant herein that the polymers have a solubility greater than 5 g/l at 20° C.

Suitable polymers for use herein are acidic. By acidic, it is meant herein that a 1% solution of said polymers has a pH of less than 7, preferably less than 5.5.

Suitable polymers for use herein have a molecular weight in the range of from 1000 to 280,000, preferably from 1500 to 150,000, preferably, suitable polymers for use herein have a melting point above 30° C.

Suitable polymers which meet the above criteria and are therefore particularly useful in the present invention, include those having he following empirical formula I

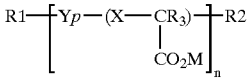

(I)

wherein X is 0 or CH2; Y is a comonomer or comonomer mixture; R1 and R2 are bleach-stable polymer-end groups; R3 is H, OH or C1–4 alkyl; M is H, and mixtures thereof with alkali metal, alkaline earth metal, ammonium or substituted ammonium; p is from 0 to 2; and n is at least 10, and mixtures thereof. The proportion of M being H in such polymers must be such as to ensure that the polymer is sufficiently acidic to meet the acidity criteria as hereinbefore defined.

Polymers according to formula I are known in the field of laundry detergents, and are typically used as chelating agents, as for instance in GB-A-1,597,756. Preferred polycarboxylate polymers fall into several categories. A first category belongs to the class of copolymeric polycarboxylate polymers which, formally at least, are formed from an unsaturated polycarboxylic acid such as maleic acid, citraconic acid, itaconic acid and mesaconic acid as first monomer, and an unsaturated monocarboxylic acid such as acrylic acid or an alpha-C1–C4 alkyl acrylic acid as second monomer. Referring to formula I, therefore, preferred polycarboxylate polymers of this type are those in which X is CHO, R3 is H or C1–4 alkyl, especially methyl, p is from about 0.1 to about 1.9, preferably from about 0.2 to about 1.5, n averages from about 10 to about 1500, preferably from about 50 to about 1000, more preferably from 100 to 103, especially from 120 to 400 and Y comprises monomer units of formula II

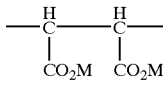

(II)

Such polymers are available from BASF under the trade name Sokalan® CP5 (neutralised form) and Sokajan® CP45 (acidic form).

A second category belongs to the class of polycarboxylate polymers in which referring to formula I, X is CH2, R3 is OH, p is from 0 to 0.1, preferably 0 and n averages from about 50 to about 1500, preferably from about 100 to 1000.

Y, if present, can be a polycarboxylic acid such as II above, or an ethylene oxide moiety.

A third category belongs to the class of acetal polycarboxylate polymers in which, referring to formula I, X is (OR4)2, where R4 is C1–C4 alkyl, R3 is H, p is from 0 to 0.1, preferably 0 and n averages from 10 to 500. If present, Y again can be a polycarboxylic acid such as II above or an ethyleneoxide moiety.

A fourth category belongs to the class of polycarboxylate polymers in which referring to formula I, X is CH2, R3 is H or C1–4 alkyl, p is 0 and n averages from about 10 to 1500, preferably from about 500 to 1000.

A fifth category of polycarboxylate polymers has the formula I in which X is CH2, R3 is H or C1–4 alkyl, especially methyl, p is from 0.01 to 0.09, preferably from 0.02 to 0.06, n averages from about 10 to about 1500, preferably from about 15 to about 300 and Y is a polycarboxylic acid formed from maleic acid, citraconic acid, mitaconic acid or mesaconic acid, highly preferred being maleic acid-derived comonomers of formula II above.

Suitable polymer end groups in formula I suitably include alkyl groups, oxyalkyl groups and alkyl carboxylic acid groups and salts and esters thereof.

In formula I above, M is H or mixtures thereof with alkali metal, alkaline earth metal, ammonium or substituted ammonium. The proportion of M which is H is such as to ensure that the polymer meets the pH criteria described herein above.

In the above, n, the degree of polymerization of the polymer can be determined from the weight average polymer molecular weight by dividing the latter by the average monomer molecular weight. Thus, for a maleic-acrylic copolymer having a weight average molecular weight of 15,500 and comprising 30 mole % of maleic acid derived units, n is 182 (i.e. 15,00/(116×0.3+72×0.7).

In case of doubt, weight-average polymer molecular weights can be determined herein by gel permeation chromotography using Water [mu] Porasil (RTM) GPC 60 A2 and (mu) Bondage (RTM) E-125, E-500 and E-1000 in series, temperature-controlled columns at 40° C. against sodium polystyrene sulphonate polymer standards, available from Polymer Laboratories Ltd., Shropshire, UK, the polymer standards being 0.15M sodium dihydrogen phosphate and 0.02M tetramethyl ammonium hydroxide at pH 7.0 in 80/20 water/acetonitrile.

Mixtures of polycarboxylate polymers are also suitable herein, especially mixtures comprising a high molecular weight component having an n value of at least 100, preferably at least 120, and a low molecular weight component having an n value of less than 100, preferably from 10 to 90, more preferably from 20 to 80. Such mixtures are optimum from the viewpoint of providing excellent bleach stability and anti-incrustation performance in the context of a zerophosphate detergent formula.

In mixtures of this type, the weight ratio of high molecular weight component to low molecular weight component is generally at least hi, preferably from about 1:1 to about 20:1, more preferably from about 1.5:1 to about 10.1, especially from about 2:1 to about 8:1.

Preferred polycarboxylate polymers of the low molecular weight type are polycarboxylate polymers of the fourth category (homopolyacrylate polymers) listed above.

Of all the above, highly preferred polycarboxylate polymers herein are those of the first category in which n averages from 100 to 800, preferably from 120 to 400 and mixtures thereof with polycarboxylate polymers of the fourth category in which n averages from 10 to 90, preferably from 20 to 80.

Other suitable polymers for use herein include polymers derived from amino acids such as polyglutamine acid, as disclosed in co-pending application GB 91-20653.2, and polyaspartic acid, as disclosed in EP 305 282, and EP 351 629.

Alternatively, the binder component may be a component together with an acid e.g., Polyvinyl alcohol and a liquid acid.

Particle with Enhanced Stability

It is essential that the air bleaching catalyst is close to or in contact with an acidic material. The air bleaching catalyst is in the form of a particle that is amorphous or crystalline. The size of particle may be in the range of 0.01 to 3000 $\mu$m. It is most preferred that the air bleaching catalyst has a particle size in the range of 5 to 1000 $\mu$m, most preferably 50 $\mu$m to 100 $\mu$m. The size as given is the maximum length in any one direction of the particle.

The air bleaching catalyst may be pre-mixed with a water-soluble salt to form a first granule that is coated with an acidic material or mixed therewith. Generally, the air bleaching catalyst is present in the first granule in the range 1 to 10%, preferably 1 to 5%, and most preferably 1 to 2%. Preferred water-soluble salts are sodium sulphate and sodium chloride, most preferred is sodium sulphate.

Method of Coating with the Acidic Binder

The coating of the co-agglomerated material with the coating material can be carried out in several ways and the process itself is not critical to the present invention.

The coating material may be sprayed on as a molten material or as a solution or dispersion in a solvent/carrier liquid that is subsequently removed by evaporation.

The coating material can also be applied as a powder coating e.g. by electrostatic techniques although this is less preferred as the adherence of powdered coating material is more difficult to achieve and can be more expensive.

Molten coating is a preferred technique for coating materials of Mpt <80° C. but is less convenient for higher Melting Point acids (i.e. >100° C.). For coating materials of Mpt >80° C., spray on as a solution or dispersion is preferred. Organic solvents such as ethyl and isopropyl alcohol can be used to form the solutions or dispersions, although this will necessitate a solvent recovery stage in order to make their use economic. However, the use of organic solvents also gives rise to safety problems such as flammability and operator safety and thus aqueous solutions or dispersions are preferred.

Within the context of the present application an acidic component that has been applied by spraying or otherwise on a granule containing the air bleaching catalyst or air bleaching catalyst per se will form part of the granule or granule to be formed hence the acidic component applied in this manner, in form and function, is a cogranulant or binder.

Aqueous solutions are particularly advantageous as the coating materials herein have a high aqueous solubility, provided the solution has a sufficiently low viscosity to enable it to be handled. Preferably a concentration of at least 25% by weight of the coating material in the solvent is used in order to reduce the drying/evaporation Load after surface treatment has taken place. The treatment apparatus can be any of those normally used for this purpose, such as inclined rotary pans, rotary drums and fluidised beds.

All of the ingredients of the final composition may be mixed or blended in any suitable piece of equipment, such as a rotating drum. Liquid ingredients such as nonionic surfactant and perfume may be sprayed on to the surface of one or more of the constituent particles.

Appropriate choice of constituent particles is required in order to ensure that the finished composition has a bulk density of at least 350 g/l, preferably 750–1100 g/l.

Bleach Catalyst

The term air bleach catalyst as used herein is one that is capable of bleaching a substrate in the absence of an added peroxyl species. The bleach catalyst per se may be selected from a wide range of transition metal complexes of organic molecules (ligands). Suitable organic molecules (ligands)

for forming complexes and complexes thereof are found, for example in: GB 9906474.3; GB 9907714.1; GB 98309168.7, GB 98309169.5; GB 9027415.0 and GB 9907713.3; DE 19755493; EP 999050; WO-A-9534628; EP-A-458379; EP 0909809; U.S. Pat. No. 4,728,455; WO-A-98/39098; WO-A-98/39406, WO 9748787, WO 0029537; WO 0052124, and WO0060045 the complexes and organic molecule (ligand) precursors of which are herein incorporated by reference.

The ligand forms a complex with one or more transition metals, in the latter case for example as a dinuclear complex. Suitable transition metals include for example: manganese in oxidation states II-V, iron II-V, copper I-III, cobalt I-III, titanium II-IV, tungsten IV-VI, vanadium II-V and molybdenum II-VI.

The transition metal complex preferably is of the general formula (AI):

$$[M_aL_kX_n]Y_m$$

in which:

M represents a metal selected from Mn(II)-(III)-(IV)-(V), Cu(I)-(II)-(III), Fe (II)-(III)-(IV)-(V), Co(I)-(II)-(III), Ti(II)-(II)-(IV), V(I)-(III)-(IV)-(V), Mo(II)-(III)-(IV)-(V)-(VI) and W(IV)-(V)-(VI), preferably from Fe(II)-(III)-(IV)-(V);

L represents the ligand, preferably N,N-bis(pyridin-2-yl-methyl)-1,1-bis(pyridin-2-yl)-1-aminoethane, or its protonated or deprotonated analogue;

X represents a coordinating species selected from any mono, bi or tri charged anions and any neutral molecules able to coordinate the metal in a mono, bi or tridentate manner;

Y represents any non-coordinated counter ion;

a represents an integer from 1 to 10;

k represents an integer from 1 to 10;

n represents zero or an integer from 1 to 10;

m represents zero or an integer from 1 to 20.

Preferably, the complex is an iron complex comprising the ligand N,N-bis(pyridin-2-yl-methyl)-1,1-bis(pyridin-2-yl)-1-aminoethane. Suitable classes of ligands are described below:

(A) Ligands of the General Formula (IA):

(IA)

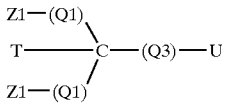

wherein

Z1 groups independently represent a coordinating group selected from hydroxy, amino, —NHR or —$N(R)_2$ (wherein R=$C_{1-6}$-alkyl), carboxylate, amido, —NH—$C(NH)NH_2$, hydroxyphenyl, a heterocyclic ring optionally substituted by one or more functional groups E or a heteroaromatic ring optionally substituted by one or more functional groups E, the heteroaromatic ring being selected from pyridine, pyrimidine, pyrazine, pyrazole, imidazole, benzimidazole, quinoline, quinoxaline, triazole, isoquinoline, carbazole, indole, isoindole, oxazole and thiazole;

Q1 and Q3 independently represent a group of the formula:

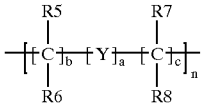

wherein

5≧a+b+c≧1; a=0–5; b=0–5; c=0–5; n=0 or 1 (preferably n=0);

Y independently represents a group selected from —O—, —S—, —SO—, —$SO_2$—, —C(O)—, arylene, alkylene, heteroarylene, heterocycloalkylene, —(G)P—, —P(O)— and —(G)N—, wherein G is selected from hydrogen, alkyl, aryl, arylalkyl, cycloalkyl, each except hydrogen being optionally substituted by one or more functional groups E;

R5, R6, R7, R8 independently represent a group selected from hydrogen, hydroxyl, halogen, —R and —OR, wherein R represents alkyl, alkenyl, cycloalkyl, heterocycloalkyl, aryl, heteroaryl or a carbonyl derivative group, R being optionally substituted by one or more functional groups E, or R5 together with R6, or R7 together with R8, or both, represent oxygen, or R5 together with R7 and/or independently R6 together with R8, or R5 together with R8 and/or independently R6 together with R7, represent $C_{1-6}$-alkylene optionally substituted by $C_{1-4}$-alkyl, —F, —Cl, —Br or —I;

T represents a non-coordinated group selected from hydrogen, hydroxyl, halogen, —R and —OR, wherein R represents alkyl, alkenyl, cycloalkyl, heterocycloalkyl, aryl, arylalkyl, heteroaryl or a carbonyl derivative group, R being optionally substituted by one or more functional groups c (preferably T=—H, —OH, methyl, methoxy or benzyl);

U represents either a non-coordinated group T independently defined as above or a coordinating group of the general formula (IIA), (IIIA) or (IVA):

(IIA)

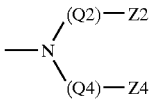

(IIIA)

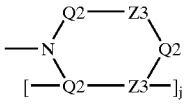

(IVA)

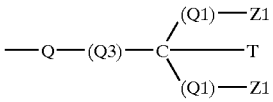

wherein

Q2 and Q4 are independently defined as for Q1 and Q3;

Q represents —N(T)— (wherein T is independently defined as above), or an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole;

Z2 is independently defined as for Z1;

Z3 groups independently represent —N(T)— (wherein T is independently defined as above);

Z4 represents a coordinating or non-coordinating group selected from hydrogen, hydroxyl, halogen, —NH—C(NH)$NH_2$, —R and —OR, wherein R= alkyl, alkenyl, cycloalkyl, heterocycloalkyl, aryl, heteroaryl or a carbonyl derivative group, R being optionally substituted by one or more functional groups E, or Z4 represents a group of the general formula (IIAa)

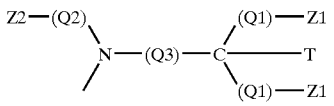

(IIAa)

and $1 \leqq j < 4$.

Preferably, Z1, Z2 and Z4 independently represent an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole. More preferably, Z1, Z2 and Z4 independently represent groups selected from optionally substituted pyridin-2-yl, optionally substituted imidazol-2-yl, optionally substituted imidazol-4-yl, optionally substituted pyrazol-1-yl, and optionally substituted quinolin-2-yl. Most preferred is that Z1, Z2 and Z4 each represent optionally substituted pyridin-2-yl.

The groups Z1, Z2 and Z4 if substituted, are preferably substituted by a group selected from $C_{1-4}$-alkyl, aryl, arylalkyl, heteroaryl, methoxy, hydroxy, nitro, amino, carboxyl, halo, and carbonyl. Preferred is that Z1, Z2 and Z4 are each substituted by a methyl group. Also, we prefer that the Z1 groups represent identical groups.

Each Q1 preferably represents a covalent bond or C1–C4-alkylene, more preferably a covalent bond, methylene or ethylene, most preferably a covalent bond.

Group Q preferably represents a covalent bond or C1–C4-alkylene, more preferably a covalent bond.

The groups R5, R6, R7, R8 preferably Independently represent a group selected From —H, hydroxy-$C_0$–$C_{20}$-alkyl, halo-$C_0$–$C_{20}$-alkyl, nitroso, formyl-$C_0$–$C_{20}$-alkyl, carboxyl-$C_0$–$C_{20}$-alkyl and esters and salts thereof, carbamoyl-$C_0$–$C_{20}$-alkyl, sulfo-$C_0$–$C_{20}$-alkyl and esters and salts thereof, sulfamoyl-$C_0$–$C_{20}$-alkyl, amino-$C_0$–$C_{20}$-alkyl, aryl-$C_0$–$C_{20}$-alkyl, $C_0$–$C_{20}$-alkyl, alkoxy-$C_0$–$C_8$-alkyl, carbonyl-$C_0$–$C_6$-alkoxy, and $C_0$–$C_{20}$-alkylamide. Preferably, none of R5-R8 is linked together.

Non-coordinated group T preferably represents hydrogen, hydroxy, methyl, ethyl, benzyl, or methoxy.

In one aspect, the group U in formula (IA) represents a coordinating group of the general formula (IIA):

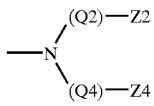

(IIA)

According to this aspect, it is preferred that Z2 represents an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole, more preferably optionally substituted pyridin-2-yl or optionally substituted benzimidazol-2-yl.

It is also preferred, in this aspect, that Z4 represents an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole, more preferably optionally substituted pyridin-2-yl, or an non-coordinating group selected from hydrogen, hydroxy, alkoxy, alkyl, alkenyl, cycloalkyl, aryl, or benzyl.

In preferred embodiments of this aspect, the ligand is selected from:

1,1-bis(pyridin-2-yl)-N-methyl-N-(pyridin-2-ylmethyl) methylamine;

1,1-bis(pyridin-2-yl)-N,N-bis(6-methyl-pyridin-2-ylmethyl)methylamine;

1,1-bis(pyridin-2-yl)-N,N-bis(5-carboxymethyl-pyridin-2-ylmethyl)methylamine;

1,1-bis(pyridin-2-yl)-1-benzyl-N,N-bis(pyridin-2-ylmethyl)methylamine; and 1,1-bis(pyridin-2yl)-N,N-bis(benzimidazol-2-ylmethyl) methylamine.

In a variant of this aspect, the group Z4 in formula (IIA) represents a group of the general formula (IIAa):

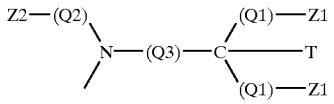

(IIAa)

In this variant, Q4 preferably represents optionally substituted alkylene, preferably —$CH_2$—CHOH—$CH_2$— or —$CH_2$—$CH_2$—$CH_2$—. In a preferred embodiment of this variant, the ligand is:

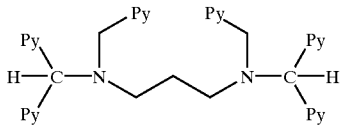

wherein —Py represents pyridin-2-yl.

In another aspect, the group U in formula (IA) represents a coordinating group of the general formula (IIIA):

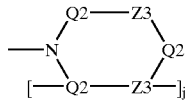

(IIIA)

wherein j is 1 or 2, preferably 1.

According to this aspect, each Q2 preferably represents —$(CH_2)_n$— (n=2–4), and each Z3 preferably represents —N(R)— wherein R=—H or $C_{1-4}$-alkyl, preferably methyl.

In preferred embodiments of this aspect, the ligand is selected from:

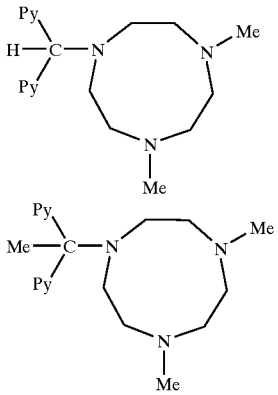

wherein —Py represents pyridin-2-yl.

In yet another aspect, the group U in formula (IA) represents a coordinating group of the general formula (IVA):

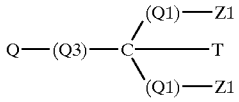

(IVA)

In this aspect, Q preferably represents —N(T)— (wherein T=—H, methyl, or benzyl) or pyridin-diyl.

In preferred embodiments of this aspect, the ligand is selected from:

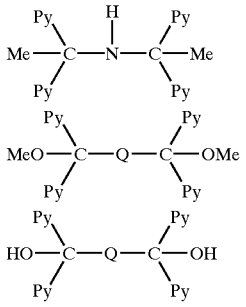

wherein —Py represents pyridin-2-yl, and —Q— represents pyridin-2,6-diyl.

(B) Ligands of the General Formula (IB):

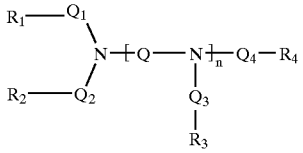

(IB)

wherein n=1 or 2, whereby if n=2, then each —$Q_3$—$R_3$ group is independently defined;

$R_1$, $R_2$, $R_3$, $R_4$ independently represent a group selected from hydrogen, hydroxyl, halogen, —NH—C(NH)$NH_2$, —R and —OR, wherein R= alkyl, alkenyl, cycloalkyl, heterocycloalkyl, aryl, heteroaryl or a carbonyl derivative group, R being optionally substituted by one or more functional groups E, $Q_1$, $Q_2$, $Q_3$, $Q_4$ and Q independently represent a group of the formula:

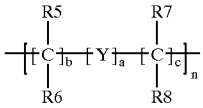

wherein

5≧a+b+c≧1; a=0–5; b=0–5; c=0–5; n=1 or 2;

Y independently represents a group selected from —O—, —S—, —SO—, —$SO_2$—, —C(O)—, arylene, alkylene, heteroarylene, heterocycloalkylene, —(G)P—, —P(O)— and —(G)N—, wherein G is selected from hydrogen, alkyl, aryl, arylalkyl, cycloalkyl, each except hydrogen being optionally substituted by one or more functional groups E;

$R_5$, $R_6$, $R_7$, $R_8$ independently represent a group selected from hydrogen, hydroxyl, halogen, —R and —OR, wherein R represents alkyl, alkenyl, cycloalkyl, heterocycloalkyl, aryl, heteroaryl or a carbonyl derivative group, R being optionally substituted by one or more functional groups E, or R5 together with R6, or R7 together with R8, or both, represent oxygen, or R5 together with R7 and/or independently R6 together with R8, or R5 together with R8 and/or independently R6 together with R7, represent $C_{1-6}$-alkylene optionally substituted by $C_{1-4}$-alkyl, —F, —Cl, —Br or —I, provided that at least two of $R_1$, $R_2$, $R_3$, $R_4$ comprise coordinating heteroatoms and no more than six heteroatoms are coordinated to the same transition metal atom.

At least two, and preferably at least three, of $R_1$, $R_2$, $R_3$, $R_4$ independently represent a group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole.

Preferably, substituents for groups $R_1$, $R_2$, $R_3$, $R_4$, when representing a heterocyclic or heteroaromatic ring, are selected from $C_{1-4}$-alkyl, aryl, arylalkyl, heteroaryl, methoxy, hydroxy, nitro, amino, carboxyl, halo, and carbonyl.

The groups $Q_1$, $Q_2$, $Q_3$, $Q_4$ preferably independently represent a group selected from —$CH_2$— and —$CH_2CH_2$—.

Group Q is preferably a group selected from —$(CH_2)_{2-4}$—, —$CH_2$CH (OH) $CH_2$—,

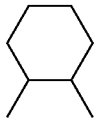

optionally substituted by methyl or ethyl,

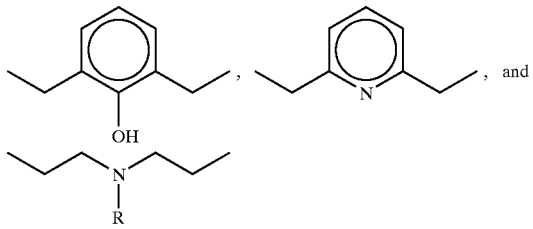

wherein R represents —H or $C_{1-4}$-alkyl.

Preferably, $Q_1$, $Q_2$, $Q_3$, $Q_4$ are defined such that a=b=0, c=1 and n=1, and Q is defined such that a=b=0, c=2 and n=1.

The groups R5, R6, R7, R8 preferably independently represent a group selected from —H, hydroxy-$C_0$–$C_{20}$-alkyl, halo-$C_0$–$C_{20}$-alkyl, nitroso, formyl-$C_0$–$C_{20}$-alkyl, carboxyl-$C_0$–$C_{20}$-alkyl and esters and salts thereof, carbamoyl-$C_0$–$C_{20}$-alkyl, sulfo-$C_0$–$C_{20}$-alkyl and esters and salts thereof, sulfamoyl-$C_0$–$C_{20}$-alkyl, amino-$C_0$–$C_{20}$-alkyl, aryl-$C_0$–$C_{20}$-alkyl, $C_0$–$C_{20}$-alkyl, alkoxy-$C_0$–$C_9$-alkyl, carbonyl-$C_0$–$C_6$-alkoxy, and $C_0$–$C_{20}$-alkylamide. Preferably, none of R5–R8 is linked together.

In a preferred aspect, the ligand is of the general formula (IIB):

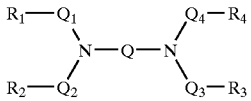

(IIB)

wherein $Q_1$, $Q_2$, $Q_3$, $Q_4$ are defined such that a=b=0, c=1 or 2 and n=1;

Q is defined such that a=b=0, c=2,3 or 4 and n=1; and $R_1$, $R_2$, $R_3$, $R_4$, R7, R8 are independently defined as for formula (I).

Preferred classes of ligands according to this aspect, as represented by formula (IIB) above, are as follows:

(i) Ligands of the General Formula (IIB) wherein:

$R_1$, $R_2$, $R_3$, $R_4$ each independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole.

In this class, we prefer that:

Q is defined such that a=b=0, c=2 or 3 and n=1;

$R_1$, $R_2$, $R_3$, $R_4$ each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl.

(ii) Ligands of the General Formula (IIB) wherein:

$R_1$, $R_2$, $R_3$ each independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole; and $R_4$ represents a group selected from hydrogen, $C_{1-20}$ optionally substituted alkyl, $C_{1-20}$ optionally substituted arylalkyl, aryl, and $C_{1-20}$ optionally substituted $NR_3^+$ (wherein R=$C_{1-8}$-alkyl).

In this class, we prefer that:

Q is defined such that a=b=0, c=2 or 3 and n=1;

$R_1$, $R_2$, $R_3$ each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl; and $R_4$ represents a group selected from hydrogen, $C_{1-10}$ optionally substituted alkyl, $C_{1-5}$-furanyl, $C_{1-5}$ optionally substituted benzylalkyl, benzyl, $C_{1-5}$ optionally substituted alkoxy, and $C_{1-20}$ optionally substituted $N^+Me_3$.

(iii) Ligands of the General Formula (IIB) wherein:

$R_1$, $R_4$ each independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole; and $R_2$, $R_3$ each independently represent a group selected from hydrogen, $C_{1-20}$ optionally substituted alkyl, $C_{1-20}$ optionally substituted arylalkyl, aryl, and $C_{1-20}$ optionally substituted $NR_3^+$ (wherein R=$C_{1-8}$-alkyl).

In this class, we prefer that:

Q is defined such that a=b=0, c=2 or 3 and n=1;

$R_1$, $R_4$ each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl; and $R_2$, $R_3$ each independently represent a group selected from hydrogen, $C_{1-10}$ optionally substituted alkyl, $C_{1-5}$-furanyl, $C_{1-5}$ optionally substituted benzylalkyl, benzyl, $C_{1-5}$ optionally substituted alkoxy, and $C_{1-20}$ optionally substituted $N^+Me_3$.

Examples of preferred ligands in their simplest forms are:

N,N',N'-tris(3-methyl-pyridin-2-ylmethyl)-ethylenediamine; N-trimethylammoniumpropyl-N,N',N'-tris(pyridin-2-ylmethyl)-ethylenediamine;

N-(2-hydroxyethylene)-N,N',N'-tris(pyridin-2-ylmethyl)-ethylenediamine;

N,N,N',N'-tetrakis (3-methyl-pyridin-2-ylmethyl)-ethylene-diamine;

N,N'-dimethyl-N,N'-bis(pyridin-2-ylmethyl)-cyclohexane-1,2-diamine;

N-(2-hydroxyethylene)-N,N',N'-tris(3-methyl-pyridin-2-ylmethyl)-ethylenediamine;

N-methyl-N, N',N'-tris (pyridin-2-ylmethyl)-ethylenediamine;

N-methyl-N,N',N'-tris(5-ethyl-pyridin-2-ylmethyl)-ethylenediamine;

N-methyl-N,N',N'-tris(5-methyl-pyridin-2-ylethyl)-ethylenediamine;

N-methyl-N,N',N'-tris(3-methyl-pyridin-2-ylmethyl)-ethylenediamine;

N-benzyl-N,N',N'-tris(3-methyl-pyridin-2-ylmethyl)-ethylenediamine;

N-ethyl-N,N',N'-tris(3-methyl-pyridin-2-ylmethyl)-ethylethylenediamine;

N,N,N'-tris(3-methyl-pyridin-2-ylmethyl)-N'(-methoxyethyl-1-)-ethylenediamine;

N,N,N'-tris (1-methyl-benzimidazol-2-yl)-N'-methylethylenediamine;

N-(furan-2-yl)-N,N',N'-tris(3-methyl-pyridin-2-ylmethyl)-ethylenediamine;

N-(2-hydroxyethylene)-N,N',N'-tris(3-ethyl-pyridin-2-ylmethyl)-ethylenediamine;

N-methyl-N,N',N'-tris (3-methyl-pyridin-2-ylmethyl) ethylene-1,2-diamine;

N-ethyl-N,N',N'-tris(3-methyl-pyridin-2-ylmethyl) ethylene-1,2-diamine;

N-benzyl-N,N',N'-tris(3-methyl-pyridin-2-ylmethyl) ethylene-1,2-diamine;

N-(2-hydroxyethyl)-N,N',N'-tris(3-methyl-pyridin-2-ylmethyl)ethylene-1,2-diamine;

N-(2-methoxyethyl)-N,N',N'-tris(3-methyl-pyridin-2-ylmethyl)ethylene-1,2-diamine;

N-methyl-N,N',N'-tris (5-methyl-pyridin-2-ylmethyl) ethylene-1,2-diamine;

N-ethyl-N,N',N'-tris(5-methyl-pyridin-2-ylmethyl) ethylene-1,2-diamine;

N-benzyl-N,N',N'-tris(5-methyl-pyridin-2-ylmethyl) ethylene-1,2-diamine;

N-(2-hydroxyethyl)-N,N',N'-tris (5-methyl-pyridin-2-ylmethyl) ethylene-1,2-diamine;

N-(2-methoxyethyl)-N,N',N'-tris(5-methyl-pyridin-2-ylmethyl) ethylene-1,2-diamine;

N-methyl-N,N',N'-tris(3-ethyl-pyridin-2-ylmethyl) ethylene-1,2-diamine;

N-ethyl-N,N',N'-tris(3-ethyl-pyridin-2-ylmethyl) ethylene-1,2-diamine;

N-benzyl-N,N',N'-tris(3-ethyl-pyridin-2-ylmethyl) ethylene-1,2-diamine;

N-(2-hydroxyethyl)-N,N',N'-tris(3-ethyl-pyridin-2-ylmethyl)ethylene-1,2-diamine;

N-(2-me7-oxyethyl)-N,N',N'-tris(3-ethyl-pyridin-2-ylmethyl)ethylene-1,2-diamine;

N-methyl-N,N',N'-tris(5-ethyl-pyridin-2-ylmethyl) ethylene-1,2-diamine;

N-ethyl-N,N',N'-tris(5-ethyl-pyridin-2-ylmethyl) ethylene-1,2-diamine;

N-benzyl-N,N',N'-tris(5-ethyl-pyridin-2-ylmethyl) ethylene-1,2-diamine; and

N-(2-methoxyethyl)-N,N',N'-tris(5-ethyl-pyridin-2-ylmethyl)ethylene-1,2-diamine.

More preferred ligands are:

N-methyl-N,N',N'-tris(3-methyl-pyridin-2-ylmethyl) ethylene-1,2-diamine;

N-ethyl-N,N',N'-tris(3-methyl-pyridin-2-ylmethyl) ethylene-1,2-diamine;

N-benzyl-N,N',N'-tris(3-methyl-pyridin-2-ylmethyl) ethylene-1,2-diamine;

N-(2-hydroxyethyl)-N,N',N'-tris(3-methyl-pyridin-2-ylmethyl)ethylene-1,2-diamine; and N-(2-methoxyethyl)-N,N',N'-tris(3-methyl-pyridin-2-ylmethyl) ethylene-1,2-diamine.

(C) Ligands of the General Formula (IC):

(IC)

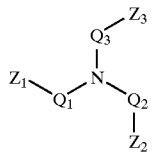

wherein $Z_1$, $Z_2$ and $Z_3$ independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole;

$Q_1$, $Q_2$, and $Q_3$ independently represent a group of the formula:

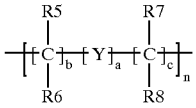

wherein $5 \geqq a+b+c \geqq 1$; a=0–5; b=0–5; c=0–5; n=1 or 2;

Y independently represents a group selected from —O—, —S—, —SO—, —$SO_2$—, —C(O)—, arylene, alkylene, heteroarylene, heterocycloalkylene, —(G)P—, —P(O)— and —(G)N—, wherein G is selected from hydrogen, alkyl, aryl, arylalkyl, cycloalkyl, each except hydrogen being optionally substituted by one or more functional groups E; and R5, R6, R7, R8 independently represent a group selected from hydrogen, hydroxyl, halogen, —R and —OR, wherein R represents alkyl, alkenyl, cycloalkyl, heterocycloalkyl, aryl, heteroaryl or a carbonyl derivative group, R being optionally substituted by one or more functional groups E, or R5 together with R6, or R7 together with R8, or both, represent oxygen, or R5 together with R7 and/or independently R6 together with R8, or R5 together with R8 and/or independently R6 together with R7, represent $C_{1-6}$-alkylene optionally substituted by $C_{1-4}$-alkyl, —F, —Cl, —Br or —I.

$Z_1$, $Z_2$ and $Z_3$ each represent a coordinating group, preferably selected from optionally substituted pyridin-2-yl, optionally substituted imidazol-2-yl, optionally substituted imidazol-4-yl, optionally substituted pyrazol-1-yl, and optionally substituted quinolin-2-yl. Preferably, $Z_1$, $Z_2$ and $Z_3$ each represent optionally substituted pyridin-2-yl.

Optional substituents for the groups $Z_1$, $Z_2$ and $Z_3$ are preferably selected from $C_{1-4}$-alkyl, aryl, arylalkyl, heteroaryl, methoxy, hydroxy, nitro, amino, carboxyl, halo, and carbonyl, preferably methyl.

Also preferred is that $Q_1$, $Q_2$ and $Q_3$ are defined such that a=b=0, c=1 or 2, and n=1.

Preferably, each $Q_1$, $Q_2$ and $Q_3$ independently represent $C_{1-4}$-alkylene, more preferably a group selected from —$CH_2$— and —$CH_2CH_2$—.

The groups R5, R6, R7, R8 preferably independently represent a group selected from —H, hydroxy-$C_0$–$C_{20}$-alkyl, halo-$C_0$–$C_{20}$-alkyl, nitroso, formyl-$C_0$–$C_{20}$-alkyl, carboxyl-$C_0$–$C_{20}$-alkyl and esters and salts thereof, carbamoyl-$C_0$–$C_{20}$-alkyl, sulfo-$C_0$–$C_{20}$-alkyl and esters and salts thereof, sulfamoyl-$C_0$–$C_{20}$-alkyl, amino-$C_0$–$C_{20}$-alkyl, aryl-$C_0$–$C_{20}$-alkyl, $C_0$–$C_{20}$-alkyl, alkoxy-$C_0$–$C_8$-alkyl, carbonyl-$C_0$–$C_6$-alkoxy, and $C_0$–$C_{20}$-alkylamide. Preferably, none of R5–R8 is linked together.

Preferably, the ligand is selected from tris(pyridin-2-ylmethyl)amine, tris(3-methyl-pyridin-2-ylmethyl))amine, tris (5-methyl-pyridin-2-ylmethyl)amine, and tris(6-methyl-pyridin-2-ylmethyl)amine.

(D) Ligands of the General Formula (ID):

(ID)

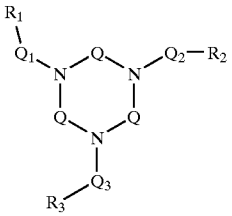

wherein $R_1$, $R_2$, and $R_3$ independently represent a group selected from hydrogen, hydroxyl, halogen, —NF—C(NH)$NH_2$, —R and —OR, wherein R= alkyl, alkenyl, cycloalkyl, heterocycloalkyl, aryl, heteroaryl or a carbonyl derivative group, R being optionally substituted by one or more functional groups E;

Q independently represent a group selected from $C_{2-3}$-alkylene optionally substituted by H, benzyl or $C_{1-8}$-alkyl;

$Q_1$, $Q_2$ and $Q_3$ independently represent a group of the formula:

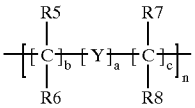

wherein $5 \geqq a+b+c \geqq 1$; a=0–5; b=0–5; c=0–5; n=1 or 2;

Y independently represents a group selected from —O—, —S—, —SO—, —$SO_2$—, —C(O)—, arylene, alkylene, heteroarylene, heterocycloalkylene, —(G)P—, —P(O)— and —(G)N—, wherein G is selected from hydrogen, alkyl, aryl, arylalkyl, cycloalkyl, each except hydrogen being optionally substituted by one or more functional groups E; and R5, R6, R7, R8 independently represent a group selected from hydrogen, hydroxyl, halogen, —R and —OR, wherein R represents alkyl, alkenyl, cycloalkyl, heterocycloalkyl, aryl, heteroaryl or a carbonyl derivative group, R being optionally substituted by one or more functional groups E, or R5 together with R6, or R7 together with R8, or both, represent oxygen, or R5 together with R7 and/or independently R6 together with R8, or R5 together with R8 and/or independently R6 together with R7, represent $C_{1-6}$-alkylene optionally substituted by $C_{1-4}$-alkyl, —F, —Cl, —Br or —I, provided that at least one, preferably at least two, of $R_1$, $R_2$ and $R_3$ is a coordinating group.

At least two, and preferably at least three, of $R_1$, $R_2$ and $R_3$ independently represent a group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole. Preferably, at least two of $R_1$, $R_2$, $R_3$ each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl.

Preferably, substituents for groups $R_1$, $R_2$, $R_3$, when representing a heterocyclic or heteroaromatic ring, are selected from $C_{1-4}$-alkyl, aryl, arylalkyl, heteroaryl, methoxy, hydroxy, nitro, amino, carboxyl, halo, and carbonyl.

Preferably, $Q_1$, $Q_2$ and $Q_3$ are defined such that a=b=0, c=1, 2, 3 or 4 and n=1. Preferably, the groups $Q_1$, $Q_2$ and $Q_3$ independently represent a group selected from —$CH_2$— and —$CH_2CH_2$—.

Group Q is preferably a group selected from —$CH_2CH_2$— and —$CH_2CH_2CH_2$—.

The groups R5, R6, R7, R8 preferably independently represent a group selected from —H, hydroxy-$C_0$–$C_{20}$-alkyl, halo-$C_0$–$C_{20}$-alkyl, nitroso, formyl-$C_0$–$C_{20}$-alkyl, carboxyl-$C_0$–$C_{20}$-alkyl and esters and salts thereof, carbamoyl-$C_0$–$C_2$,-alkyl, sulfo-$C_0$–$C_{20}$-alkyl and esters and salts thereof, sufamoyl-$C_0$–$C_{20}$-alkyl, amino-$C_0$–$C_{20}$-alkyl, aryl-$C_0$–$C_{20}$-alkyl, $C_0$–$C_{20}$-alkyl, alkoxy-$C_0$–$C_8$-alkyl, carbonyl-$C_0$–$C_6$-alkoxy, and $C_0$–$C_{20}$-alkylamide. Preferably, none of R5–R8 is linked together.

In a preferred aspect, the ligand is of the general formula (IID):

(IID)

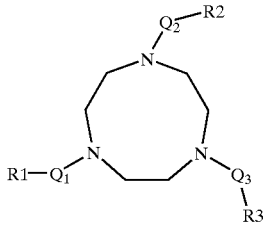

wherein R1, R2, R3 are as defined previously for $R_1$, $R_2$, $R_3$, and $Q_1$, $Q_2$, $Q_3$ are as defined previously.

Preferred classes of ligands according to this preferred aspect, as represented by formula (IID) above, are as follows:

(i) Ligands of the General Formula (IID) wherein:

R1, R2, R3 each independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole.

In this class, we prefer that:

R1, R2, R3 each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl.

(ii) Ligands of the General Formula (IID) wherein:

two of R1, R2, R3 each independently represent a coordinating group selected from carboxylate, amino, —NH— $C(NH)NH_2$, hydroxyphenyl, an optionally substituted heterocyclic ring or an optionally substituted heteroaromatic ring selected from pyridine, pyridine, pyrazine, pyrazole, imidazole, benzimidazole, quinoline, quinoxaline, triazole, isoquinoline, carbazole, indole, isoindole, oxazole and thiazole; and one of R1, R2, R3 represents a group selected from hydrogen, $C_{1-20}$ optionally substituted alkyl, $C_{1-20}$ optionally substituted arylalkyl, aryl, and $C_{1-20}$ optionally substituted $NR_3^+$ (wherein R═$C_{1-8}$-alkyl).

In this class, we prefer that:

two of R1, R2, R3 each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl; and one of R1, R2, R3 represents a group selected from hydrogen, $C_{1-10}$ optionally substituted alkyl, $C_{1-5}$-furanyl, $C_{1-5}$ optionally substituted benzylalkyl, benzyl, $C_{1-5}$ optionally substituted alkoxy, and $C_{1-20}$ optionally substituted $N^+Me_3$.

In especially preferred embodiments, the ligand is selected from:

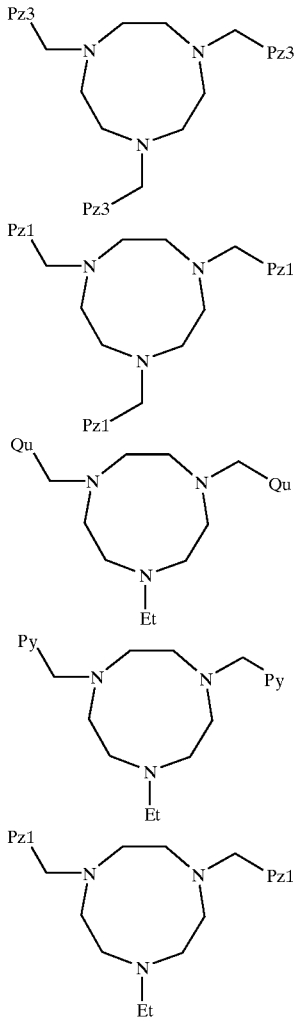

wherein —Et represents ethyl, —Py represents pyridin-2-yl, Pz3 represents pyrazol-3-yl, Pz1 represents pyrazol-1-yl, and Qu represents quinolin-2-yl.

(E) Ligands of the General Formula (IE):

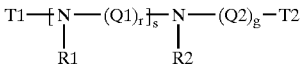

(IE)

wherein g represents zero or an integer from 1 to 6;

r represents an integer from 1 to 6;

s represents zero or an integer from 1 to 6;

Q1 and Q2 independently represent a group of the formula:

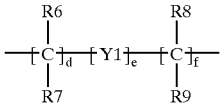

wherein

5≧d+e+f≧1; d=0–5; e=0–5; f=0–5;

each Y1 independently represents a group selected from —O—, —S—, —SO—, —$SO_2$—, —C(O)—, arylene, alkylene, heteroarylene, heterocycloalkylene, —(G)P—, —P(O)— and —(G)N—, wherein G is selected from hydrogen, alkyl, aryl, arylalkyl, cycloalkyl, each except hydrogen being optionally substituted by one or more functional groups E;

if s>1, each —[—N(R1)—$(Q1)_r$—]— group is independently defined;

R1, R2, R6, R7, R8, R9 independently represent a group selected from hydrogen, hydroxyl, halogen, —R and —OR, wherein R represents alkyl, alkenyl, cycloalkyl, heterocycloalkyl, aryl, heteroaryl or a carbonyl derivative group, R being optionally substituted by one or more functional groups E, or R6 together with R7, or R8 together with R9, or both, represent oxygen, or R6 together with R8 and/or independently R7 together with R9, or R6 together with R9 and/or independently R7 together with R8, represent $C_{1-6}$-alkylene optionally substituted by $C_{1-4}$-alkyl, —F, —Cl, —Br or —I;

or one of R1–R9 is a bridging group bound to another moiety of the same general formula;

T1 and T2 independently represent groups R4 and R5, wherein R4 and R5 are as defined for R1–R9, and if g=0 and s>0, R1 together with R4, and/or R2 together with R5, may optionally independently represent ═CH—R10, wherein R10 is as defined for R1–R9, or T1 and T2 may together (-T2-T1-) represent a covalent bond linkage when s>1 and g>0;

if T1 and T2 together represent a single bond linkage, Q1 and/or Q2 may independently represent a group of the formula: ═CH—[—Y1—]$_e$—CH═ provided R1 and/or R2 are absent, and R1 and/or R2 may be absent provided Q1 and/or Q2 independently represent a group of the formula:

═CH—[—Y1—]$_e$—CH═.

The groups R1–R9 are preferably independently selected from —H, hydroxy-$C_0$–$C_{20}$-alkyl, halo-$C_0$–$C_{20}$-alkyl, nitroso, formyl-$C_0$–$C_{20}$-alkyl, carboxyl-$C_0$–$C_{20}$-alkyl and esters and salts thereof, carbamoyl-$C_0$–$C_{20}$-alkyl, sulpho-$C_0$–$C_{20}$-alkyl and esters and salts Thereof, sulphamoyl-$C_0$–$C_{20}$-alkyl, amino-$C_0$–$C_{20}$-alkyl, aryl-$C_0$–$C_{20}$-alkyl, heteroaryl-$C_0$–$C_{20}$-alkyl, $C_0$–$C_{20}$-alkyl, alkoxy-$C_0$–$C_8$-alkyl, carbonyl-$C_0$–$C_6$-alkoxy, and aryl-$C_0$–$C_6$-alkyl and $C_0$–$C_{20}$-alkylamide.

One of R1–R9 may be a bridging group which links the ligand moiety to a second ligand moiety of preferably the same general structure. In this case the bridging group is independently defined according to the formula for Q1, Q2, preferably being alkylene or hydroxy-alkylene or a heteroaryl-containing bridge, more preferably $C_{1-6}$-alkylene optionally substituted by $C_{1-4}$-alkyl, —F, —Cl, —Br or —I.

In a first variant according to formula (IE), the groups T1 and T2 together form a single bond linkage and s>1, according to general formula (IIE):

(IIE)

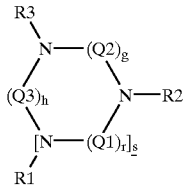

wherein R3 independently represents a group as defined for R1–R9; Q3 independently represents a group as defined for Q1, Q2; h represents zero or an 4integer from 1 to 6; and s=s−1.

In a first embodiment of the first variant, in general, formula (IIE), s=1, 2 or 3; r=g=h=1; d=2 or 3; e=f=0; R6=R7=H, preferably such that the ligand has a general formula selected from:

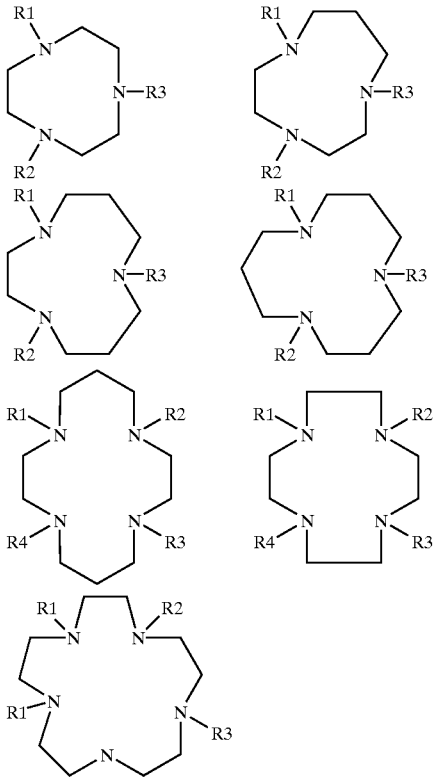

In these preferred examples, R1, R2, R3 and R4 are preferably independently selected from —H, alkyl, aryl, heteroaryl, and/or one of R1–R4 represents a bridging group bound to another moiety of the same general formula and/or two or more of R1–R4 together represent a bridging group linking N atoms in the same moiety, with the bridging group being alkylene or hydroxy-alkylene or a heteroaryl-containing bridge, preferably heteroarylene. More preferably, R1, R2, R3 and R4 are independently selected from —H, methyl, ethyl, isopropyl, nitrogen-containing heteroaryl, or a bridging group bound to another moiety of the same general formula or linking N atoms in the same moiety with the bridging group being alkylene or hydroxy-alkylene.

In a second embodiment of the first variant, in general formula (IIE), s=2 and r=g=h=1, according to the general formula:

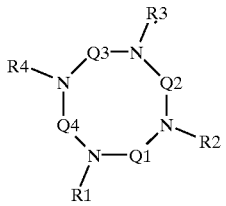

In this second embodiment, preferably R1–R4 are absent; both Q1 and Q3 represent =CH—[—Y1—]$_e$—CH=; and both Q2 and Q4 represent —$CH_2$—[—Y1—]$_n$—$CH_2$—.

Thus, preferably the ligand has the general formula:

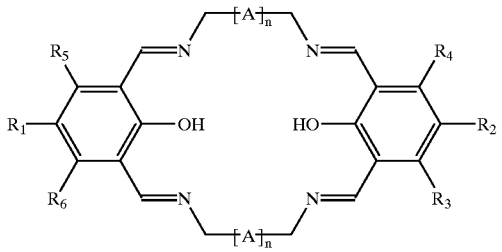

wherein A represents optionally substituted alkylene optionally interrupted by a heteroatom; and n is zero or an integer from 1 to 5.

Preferably, R1–R6 represent hydrogen, n=1 and A=—$CH_2$—, —CHOH—, —$CH_2N(R)CH_2$— or —$CH_2CH_2N(R)CH_2CH_2$— wherein R represents hydrogen or alkyl, more preferably A=—$CH_2$—, —CHOH— or —$CH_2CH_2NHCH_2CH_2$—.

In a second variant according to formula (IE), T1 and T2 independently represent groups R4, R5 as defined for R1–R9, according to the general formula (IIIE):

(IIIE)

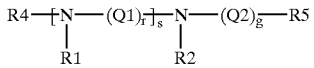

In a first embodiment of the second variant, in general formula (IIIE), s=1; r=1; g=0; d=f=1; e=0–4; Y1=—$CH_2$—; and R1 together with R4, and/or R2 together with R5, independently represent =CH—R10, wherein R10 is as defined for R1–R9. In one example, R2 together with R5 represents =CH—R10, with R1 and R4 being two separate groups. Alternatively, both R1 together with R4, and R2 together with R5 may independently represent =CH—R10. Thus, preferred ligands may for example have a structure selected from:

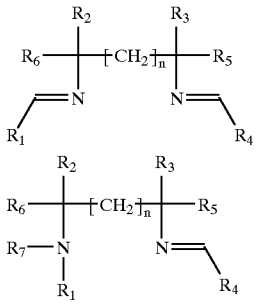

wherein n=0–4.

Preferably, the ligand is selected from:

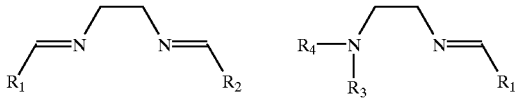

wherein R1 and R2 are selected from optionally substituted phenols, heteroaryl-$C_0$–$C_{20}$-alkyls, R3 and R4 are selected from —H, alkyl, aryl, optionally substituted phenols, heteroaryl-$C_0$–$C_{20}$-alkyls, alkylaryl, aminoalkyl, alkoxy, more preferably R1 and R2 being selected from optionally substituted phenols, heteroaryl-$C_0$–$C_2$-alkyls, R3 and R4 are selected from —H, alkyl, aryl, optionally substituted phenols, nitrogen-heteroaryl-$C_0$–$C_2$-alkyls.

In a second embodiment of the second variant, in general formula (IIIE), s=1; r=1; g=0; d=f=1; e=1–4; Y1=—C(R')(R")), wherein R' and R" are independently as defined for R1–R9. Preferably, the ligand has the general formula:

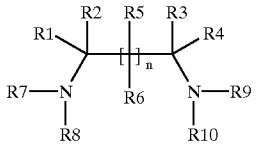

The groups R1, R2, R3, R4, R5 in this formula are preferably —H or $C_0$–$C_{20}$-alkyl, n=0 or 1, R6 is —H, alkyl, —OH or —SH, and R7, R3, R9, R10 are preferably each independently selected from —H, $C_0$–$C_{20}$-alkyl, heteroaryl-$C_0$–$C_{20}$-alkyl, alkoxy-$C_0$–$C_8$-alkyl and amino-$C_0$–$C_{20}$-alkyl.

In a third embodiment of the second variant, in general formula (IIIE), s=0; g=1; d=e=0; f=1–4. Preferably, the ligand has the general formula:

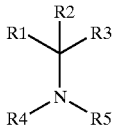

This class of ligand is particularly preferred according to the invention.

More preferably, the ligand has the general formula:

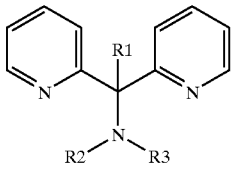

wherein R1, R2, R3 are as defined for R2, R4, R5.

In a fourth embodiment of the second variant, the ligand is a pentadentate ligand of the general formula (IVE):

(IVE)

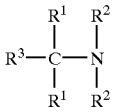

wherein each $R^1$, $R^2$ independently represents —$R^4$–$R^5$, $R^3$ represents hydrogen, optionally substituted alkyl, aryl or arylalkyl, or —$R^4$–$R^5$, each $R^4$ independently represents a single bond or optionally substituted alkylene, alkenylene, oxyalkylene, aminoalkylene, alkylene ether, carboxylic ester or carboxylic amide, and each $R^5$ independently represents an optionally N-substituted aminoalkyl group or an optionally substituted heteroaryl group selected from pyridinyl, pyrazinyl, pyrazolyl, pyrrolyl, imidazolyl, benzimidazolyl, pyrimidinyl, triazolyl and thiazolyl.

Ligands of the class represented by general formula (IVE) are also particularly preferred according to the invention. The ligand having the general formula (IVE), as defined above, is a pentadentate ligand. By 'pentadentate' herein is meant that five hetero atoms can coordinate to the metal M ion in the metal-complex.

In formula (IVE), one coordinating hetero atom is provided by the nitrogen atom in the methylamine backbone, and preferably one coordinating hetero atom is contained in each of the four $R^1$ and $R^2$ side groups. Preferably, all the coordinating hetero atoms are nitrogen atoms.

The ligand of formula (IVE) preferably comprises at least two substituted or unsubstituted heteroaryl groups in the four side groups. The heteroaryl group is preferably a pyridin-2-yl group and, if substituted, preferably a methyl- or ethyl-substituted pyridin-2-yl group. More preferably, the heteroaryl group is an unsubstituted pyridin-2-yl group.

Preferably, the heteroaryl group is linked to methylamine, and preferably to the N atom thereof, via a methylene group. Preferably, the ligand of formula (IVE) contains at least one optionally substituted amino-alkyl side group, more preferably two amino-ethyl side groups, in particular 2-(N-alkyl) amino-ethyl or 2-(N,N-dialkyl)amino-ethyl.

Thus, in formula (IVE) preferably $R^1$ represents pyridin-2-yl or $R^2$ represents pyridin-2-yl-methyl. Preferably $R^2$ or $R^1$ represents 2-amino-ethyl, 2-(N-(m)ethyl)amino-ethyl or 2-(N,N-di(m)ethyl)amino-ethyl. If substituted, $R^5$ preferably represents 3-methyl pyridin-2-yl. $R^3$ preferably represents hydrogen, benzyl or methyl.

Examples of preferred ligands of formula (IVE) in their simples forms are:

(i) Pyridin-2-yl Containing Ligands Such as:

N,N-bis(pyridin-2-yl-methyl)-bis(pyridin-2-yl) methylamine;

N,N-bis,(pyrazol-1-yl-methyl)-bis(pyridin-2-yl) methylamine;

N,N-bis(imidazol-2-yl-methyl)-bis(pyridin-2-yl) methylamine;

N,N-bis(1,2,4-triazol-1-yl-methyl)-bis(pyridin-2-yl) methylamine;

N,N-bis(pyridin-2-yl-methyl)-bis(pyrazol-1-yl) methylamine;

N,N-bis(pyridin-2-yl-methyl)-bis(imidazol-2-yl) methylamine;

N,N-bis(pyridin-2-yl-methyl)-bis(1,2,4-triazol-1-yl) ethylamine;

N,N-bis(pyridin-2-yl-methyl)-1,1-bis(pyridin-2-yl)-1-aminoethane;

N,N-bis(pyridin-2-yl-methyl)-1,1-bis(pyridin-2-yl)-2-phenyl-1-aminoethane;

N,N-bis(pyrazol-1-yl-methyl)-1,1-bis(pyridin-2-yl)-1-aminoethane;

N,N-bis(pyrazol-1-yl-methyl)-1,1-bis(pyridin-2-yl)-2-phenyl-1-aminoethane;

N,N-bis(imidazol-2-yl-methyl)-1,1-bis(pyridin-2-yl)-1-aminoethane;

N,N-bis(imidazol-2-yl-methyl)-1,1-bis(pyridin-2-yl)-2-phenyl-1-aminoethane;

N,N-bis(1,2,4-triazol-1-yl-methyl)-1,1-bis(pyridin-2-yl)-1-aminoethane;

N,N-bis(1,2,4-triazol-1-yl-methyl)-1,1-bis(pyridin-2-yl)-2-phenyl-aminoethane;

N,N-bis(pyridin-2-yl-methyl)-1,1-bis(pyrazol-1-yl)-1-aminoethane;

N,N-bis(pyridin-2-yl-methyl)-1,1-bis(pyrazol-1-yl)-2-phenyl-1-aminoethane;

N,N-bis(pyridin-2-yl-methyl)-1,1-bis(imidazol-2-yl)-1-aminoethane;

N,N-bis(pyridin-2-yl-methyl)-1,1-bis(imidazol-2-yl)-2-phenyl-1-aminoethane;

N,N-bis(pyridin-2-yl-methyl)-1,1-bis(1,2,4-triazol-1-yl)-1-aminoethane;

N,N-bis(pyridin-2-yl-methyl)-1,1-bis(1,2,4-triazol-1-yl)-1-aminoethane;

N,N-bis(pyridin-2-yl-methyl)-1,1-bis(pyridin-2-yl)-1-aminoethane;

N,N-bis(pyridin-2-yl-methyl)-1,1-bis(pyridin-2-yl)-1-aminohexane;

N,N-bis-(pyridin-2-yl-methyl)-1,1-bis(pyridin-2-yl)-2-phenyl-1-aminoethane;

N,N-bis(pyridin-2-yl-methyl)-1,1-bis(pyridin-2-yl)-2-(4-sulphonic acid-phenyl)-1-aminoethane;

N,N-bis(pyridin-2-yl-methyl)-1,1-bis(pyridin-2-yl)-2-(pyridin-2-yl)-1-aminoethane;

N,N-bis(pyridin-2-yl-methyl)-1,1-bis(pyridin-2-yl)-2-(pyridin-3-yl)-1-aminoethane;

N,N-bis(pyridin-2-yl-methyl)-1,1-bis(pyridin-2-yl)-2-(pyridin-4-yl)-1-aminoethane;

N,N-bis(pyridin-2-yl-methyl)-1,1-bis(pyridin-2-yl)-2-(1-alkyl-pyridinium-4-yl)-1-aminoethane;

N,N-bis(pyridin-2-yl-methyl)-1,1-bis(pyridin-2-yl)-2-(1-alkyl-pyridinium-3-yl)-1-aminoethane;

N,N-bis(pyridin-2-yl-methyl)-1,1-bis(pyridin-2-yl)-2-(1-alkyl-pyridinium-2-yl)-1-aminoethane;

(ii) 2-Amino-Ethyl Containing Ligands Such as:

N,N-bis(2-(N-alkyl)amino-ethyl)-bis(pyridin-2-yl) methylamine;

N,N-bis(2-(N-alkyl)amino-ethyl)-bis(pyrazol-1-yl) methylamine;

N,N-bis(2-(N-alkyl)amino-ethyl)-bis(imidazol-2-yl) methylamine;

N,N-bis(2-(N-alkyl)amino-ethyl)-bis(1,2,4-triazol-1-yl) methylamine;

N,N-bis(2-(N,N-dialkyl)amino-ethyl)-bis(pyridin-2-yl) methylamine;

N,N-bis(2-(N,N-dialkyl)amino-ethyl)-b is(pyrazol-1-yl) methylamine;

N,N-bis(2-(N,N-dialkyl)aminoethyl)-bis(imidazol-2-yl) methylamine;

N,N-bis(2-(N,N-dialkyl)amino-ethyl)-bis(1,2,4-triazol-1-yl)methylamine;

N,N-bis(pyridin-2-yl-methyl)-bis(2-amino-ethyl) methylamine;

N,N-bis(pyrazol-1-yl-methyl)-bis(2-amino-ethyl) methylamine;

N,N-bis(imidazol-2-yl-methyl)-bis(2-amino-ethyl) methylamine;

N,N-bis(1,2,4-triazol-1-yl-methyl)-bis(2-amino-ethyl) methylamine.

More preferred ligands are:

N,N-bis(pyridin-2-yl-methyl)-bis(pyridin-2-yl) methylamine, hereafter referred to as N4Py.

N,N-bis(pyridin-2-yl-methyl)-1,1-bis(pyridin-2-yl)-1-aminoethane, hereafter referred to as MeN4Py, N,N-bis(pyridin-2-yl-methyl)-1,1-bis(pyridin-2-yl)-2-phenyl-1-aminoethane, hereafter referred to as BzN4Py.

In a fifth embodiment of the second variant, the ligand represents a pentadentate or hexadentate ligand of general formula (VE):

$$R^1R^1N—W—NR^1R^2 \quad \text{(VE)}$$

wherein each $R^1$ independently represents —$R^3$—V, in which $R^3$ represents optionally substituted alkylene, alkenylene, oxyalkylene, aminoalkylene or alkylene ether, and V represents an optionally substituted heteroaryl group selected from pyridinyl, pyrazinyl, pyrazolyl, pyrrolyl, imidazolyl, benzimidazolyl, pyrimidinyl, triazolyl and thiazolyl;

W represents an optionally substituted alkylene bridging group selected from —$CH_2CH_2$—, —$CH_2CH_2CH_2$—, —$CH_2CH_2CH_2CH_2$—, —$CH_2$—$C_6H_4$—$CH_2$—, —$CH_2$—$C_6H_{10}$—$CH_2$—, and —$CH_2$—$C_{10}$H6—$CH_2$—; and $R^2$ represents a group selected from $R^1$, and alkyl, aryl and arylalkyl groups optionally substituted with a substituent selected from hydroxy, alkoxy, phenoxy, carboxylate, carboxamide, carboxylic ester, sulphonate, amine, alkylamine and $N^+(R^4)_3$, wherein $R^4$ is selected from hydrogen, alkanyl, alkenyl, arylalkanyl, arylalkenyl, oxyalkanyl, oxyalkenyl, aminoalkanyl, aminoalkenyl, alkanyl ether and alkenyl ether.

The ligand having the general formula (VE), as defined above, is a pentadentate ligand or, if $R^1$=$R^2$, can be a hexadentate ligand. As mentioned above, by 'pentadentate' is meant that five hetero atoms can coordinate to the metal M ion in the metal-complex. Similarly, by 'hexadentate' is meant that six hetero atoms can in principle coordinate to the metal M ion. However, in this case it is believed that one of the arms will not be bound in the complex, so that the hexadentate ligand will be penta coordinating.

In the formula (VE), two hetero atoms are linked by the bridging group W and one coordinating hetero atom is contained in each of the three $R^1$ groups. Preferably, the coordinating hetero atoms are nitrogen atoms.

The ligand of formula (VE) comprises at least one optionally substituted heteroaryl group in each of the three $R^1$ groups. Preferably, the heteroaryl group is a pyridin-2-yl group, in particular a methyl- or ethyl-substituted pyridin-2-yl group. The heteroaryl group is linked to an N atom in formula (VE), preferably via an alkylene group, more preferably a methylene group. Most preferably, the heteroaryl group is a 3-methyl-pyridin-2-yl group linked to an N atom via methylene.

The group $R^2$ in formula (VE) is a substituted or unsubstituted alkyl, aryl or arylalkyl group, or a group $R^1$. However, preferably $R^2$ is different from each of the groups $R^1$ in the formula above. Preferably, $R^2$ is methyl, ethyl, benzyl, 2-hydroxyethyl or 2-methoxyethyl. More preferably, $R^2$ is methyl or ethyl.

The bridging group W may be a substituted or unsubstituted alkylene group selected from $—CH_2CH_2—$, $—CH_2CH_2CH_2—$, $—CH_2CH_2CH—_2CH_2—$, $—CH_2—C_6H_4—CH_2—$, $—CH_2—C_6H_{10}—CH_2—$, and $—CH_2—C_{10}H_6—CH_2—$ (wherein $—C_6H_4—$, $—C_6H_{10}—$, $—C_{10}H_6—$ can be ortho-, para-, or meta-$C_6H_4—$, $—C_6H_{10}—$, $—C_{10}H_6—$). Preferably, the bridging group W is an ethylene or 1,4-butylene group, more preferably an ethylene group.

Preferably, V represents substituted pyridin-2-yl, especially methyl-substituted or ethyl-substituted pyridin-2-yl, and most preferably V represents 3-methyl pyridin-2-yl.

(F) Ligands of the Classes Disclosed in WO-A-98/39098 and WO-A-98/39406.

(H) Ligand Having the Formula (HI):

(HI)

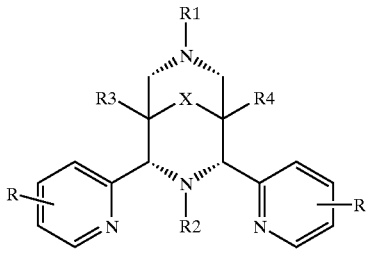

wherein each R is independently selected from: hydrogen, hydroxyl, —NH—CO—H, —NH—CO—C1–C4-alkyl, —NH2, —NH—C1–C4-alkyl, and C1–C4-alkyl;

R1 and R2 are independently selected from:

C1–C4-alkyl,

C6–C10-aryl, and, a group containing a heteroatom capable of coordinating to a transition metal, preferably wherein at least one of R1 and R2 is the group containing the heteroatom;

R3 and R4 are independently selected from hydrogen, C1–C8 alkyl, C1–C8-alkyl-O—C1–C8-alkyl, C1–C8-alkyl-O—C6–C10-aryl, C6–C10-aryl, C1–C8-hydroxyalkyl, and $—(CH2)_nC(O)OR5$ wherein R5 is C1–C4-alkyl, n is from 0 to 4, and mixtures thereof; and, X is selected from C═O, $—[C(R6)_2]_y—$ wherein Y is from 0 to 3 each R6 is independently selected from hydrogen, hydroxyl, C1–C4-alkoxy and C1–C4-alkyl.

(I) A Further Class of Ligands is the Macropolycyclic Rigid Ligand of Formula (I) Having Denticity of 3 or 4:

(I)

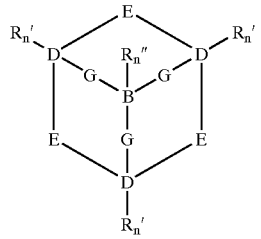

(ii) the macropolycyclic rigid ligand of formula (II) having denticity of 4 or 5

(II)

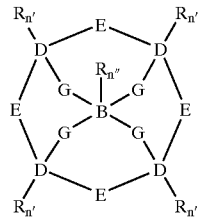

(iii) the macropolycyclic rigid ligand of formula (III) having denticity if 5 or 6:

(III)

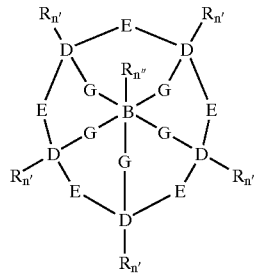

(iv) the macropolycyclic rigid ligand of formula (IV) having denticity of 6 or 7

(IV)

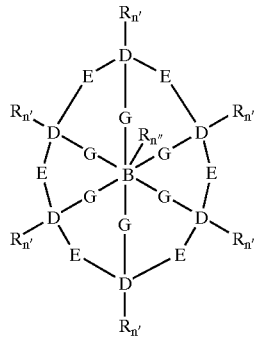

wherein in these formulas:- each "E" s the moiety $(CR_n)_a—X—(CR_n)_{a'}$, wherein X is selected from the group consisting of O, S, NR and P, or a covalent bond, and preferably X is a covalent bond and for each E the sum of a+a' is independently selected from 1 to 5, more preferably 2 and 3.

each "G" is the moiety $(CR_n)_b$.

each "R" is independently selected from H, alkyl, alkenyl, alkynyl, aryl, alkylaryl (e.g., benzyl), and heteroaryl, or two or more R are covalently bonded to form an aromatic, heteroaromatic, cycloalkyl, or heterocycloalkyl ring.

each "D" is a donor atom independently selected from the group consisting of N, O, S, and P, and at least two D atoms are bridgehead donor atoms coordinated to the transition metal (in the preferred embodiments, all donor atoms designated D are donor atoms which coordinate to the transition metal, in contrast with heteroatoms in the structure which are not in D such as those which may be present in E; the non-D heteroatoms can be non-coordinating and indeed are non-coordinating whenever present in the preferred embodiment).

"B" s a carbon atom or "D" donor atom, or a cycloalkyl or heterocyclic ring.

each "n" is an integer independently selected from 1 and 2, completing the valence of the carbon atoms to which the R moieties are covalently bonded.

each "n" is an integer independently selected from 0 and 1, completing the valence of the D donor atoms to which the R moieties are covalently bonded.

each "n" is an integer independently selected from 0,1, and 2 completing the valence of the B atoms to which the R moieties are covalently bonded.

each "a" and "a'" is an integer independently selected from 0–5, preferably a+a' equals 2 or 3, wherein the sum of all "a" plus "a'" in the ligand of formula (I) is within the range of from about 7 to about 11. The sum of all "a" plus "a" in the ligand of formula (II) is within the range of from about 6 (preferably 8) to about 12. The sum of all "a" plus "a'" in the ligand of formula (III) is within the range of from about 8 (preferably 10) to about 15, and the sum of all "a" plus "a'" in the ligand of formula (IV) is within the range of from about 10 (preferably 12) to about 18.

each "b" is an integer independently selected from 0–9, preferably 0–5 (wherein when b=0, $(CR_n)_0$ represents a covalent bond), or in any of the above formulas, one or more of the $(CR_n)_b$ moieties covalently bonded from any D to the B atom is absent as long as at least two $(CR_n)_b$ covalently bond two of the D donor atoms to the B atom in the formula, and the sum of all "b" is within the range of from about 1 to about 5.

A preferred sub-group of the transition-metal complexes includes the Mn(II), Fe(II) and Cu(II) complexes of the ligand 1.2:

1.2

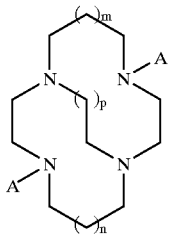

wherein m and n are integers from 0 to 2, p is an integer from 1 to 6, preferably m and n are both 0 or both 1 (preferably both 1), or m is 0 and n is at least 1; and p is 1;

and A is a nonhydrogen moiety preferably having no aromatic content; more particularly each A can vary independently and is preferably selected from methyl, ethyl, propyl, isopropyl, butyl, isobutyl, tert-butyl, C5–C20 alkyl, and one, but not both, of the A moieties is benzyl, and combinations thereof. In one such complex, one A is methyl and one A is benzyl.

Dichloro-5,12-dimethyl-1,5,8,12-tetraazabicyclo[6.6.2] hexadecane Manganese (II)

Dichloro-4,10-dimethyl-1,4,7,10-tetraazabicyclo[5.5.2] tetradecane Manganese(II)

Diaquo-5,12-dimethyl-1,5,8,12-tetraazabicyclo[6.6.2] hexadecane Manganese (II)

Hexafluorophosphate

Aquo-hydroxy-5,12-dimethyl-1,5,8,12-tetraazabicyclo [6.6.2]hexadecane Manganese(III)

Hexafluorophosphate

Diaquo-4,10-dimethyl-1,4,17,10-tetraazabicyclo[5.5.2] tetradecane Manganese(II)

Hexafluorophosphate

Diaquo-5, 12-dimethyl-1,5,8,12-tetraazabicyclo[6.6.2] hexadecane Manganese(II)

Tetrafluoroborate

Diaquo-4,10-dimethyl-1,4,7,10-tetraazabicyclo [5.5.2] tetradecane Manganese(II) Tetrafluoroborate Dichloro-5,12-dimethyl-1,5,8,12-tetraazabicyclo[6.6.2] hexadecane Manganese(III)

Hexafluorophosphate

Dichloro-5,12-di-n-butyl-1,5,8,12-tetraazabicyclo[6.6.2] hexadecane Manganese(II)

Dichloro-5,12-dibenzyl-1,5,8,12-tetraazabicyclo[6.6.2] hexadecane Manganese(II

Dichloro-5-n-butyl-12-methyl-1,5,8,12-tetraazabicyclo [6.6.2]hexadecane Manganese(II)

Dichloro-5-n-octyl-12-methyl-1,5,8,12-tetraaza-bicyclo [6.6.2]hexadecane Manganese(II) Dichloro-5-n-butyl-12-methyl-1,5,8,12-tetraaza-bicyclo[6.6.2]hexadecane Manganese (II)

Dichloro-5,12-dimethyl-1,5,8,12-tetraazabicyclo[6.6.2] hexadecane Iron(II) Dichloro-4,10-dimethyl-1,4,7,10-tetraazabicyclo[5.5.2]tetradecane Iron(II)

Dichloro-5,12-dimethyl-1,5,8,12-tetraazabicyclo[6.6.2] hexadecane Copper(II)

Dichloro-4,10-dimethyl-1,4,7,10-tetraazabicyclo[5.5.2] tetradecane Copper(II)

Dichloro-5,12-dimethyl-1,5,8,12-tetraazabicyclo[6.6.2] hexadecane Cobalt(II)

Dichloro-4,10-dimethyl-1,4,7,10-tetraazabicyclo[5.5.2] tetradecane Cobalt(II)

Dichloro-5,12-dimethyl-4-phenyl-1,5,8,12-tetraazabicyclo[6.6.2]hexadecane Manganese(II)

Dichloro-4,10-dimethyl-3-phenyl-1,4,7,10-tetraazabicyclo[5.5.2]tetradecane Manganese(II)

Dichloro-5, 12-dimethyl-4,9-diphenyl-1,5,8,12-tetraazabicyclo[6.6.2]hexadecane Manganese (II)

Dichloro-4,10-dimethyl-3,8-diphenyl-1,4,7,10-tetraazabicyclo[5.5.2]tetradecane Manganese(II)

Dichloro-5,12-dimethyl-2,11-diphenyl-1,5,8,12-tetraazabicyclo[6.6.2]hexadecane Manganese(II)

Dichloro-4,10-dimethyl-4,9-diphenyl-1,4,7,10-tetraazabicyclo[5.5.2]tetradecane Manganese (II)

Dichloro-2,4,5,9,11,12-hexamethyl-1,5,8,12-tetraazabicyclo[6.6.2]hexadecane Manganese(II)

Dichloro-2,3,5,9,10,12-hexamethyl-1,5,8,12-tetraazabicyclo[6.6.2]hexadecane Manganese(II)

Dichloro-2,2,4,5,9,9,11,12-octamethyl-1,5,8,12-tetraazabicyclo[6.6.2]hexadecane Manganese(II)

Dichloro-2,2,4,5,9,11,11,12-octamethyl-1,5,8,12-tetraazabicyclo[6.6.2]hexadecane Manganese(II)

Dichloro-3,3,5,10,10,12-hexamethyl-1,5,8,12-tetraazabicyclo[6.6.2]hexadecane Manganese(II)

Dichloro-3,5,10,12-tetramethyl-1,5,8,12-tetraazabicyclo[6.6.2]hexadecane Manganese(II)

Dichloro-3-butyl-5,10,12-trimethyl-1,5,8,12-tetraazabicyclo[6.6.2]hexadecane Manganese(II)

Dichloro-1,5,8,12-tetraazabicyclo[6.6.2]hexadecane Manganese (II)

Dichloro-1,4,7,10-tetraazabicyclo[5.5.2]tetradecane Manganese (II)

Dichloro-1,5,8,12-tetraazabicyclo[6.6.2]hexadecane Iron (II) Dichloro-!,4,7,10-tetraazabicyclo[5.5.2]-tetradecane Iron(II)

Aquo-chloro-2-(2-hydroxyphenyl)-5,12-dimethyl-1,5,8,12-tetraazabicyclo[6.6.2]hexadecane Manganese(II)

Aquo-chloro-10-(2-hydroxybenzyl)-4,10-dimethyl-1,4,7,10-tetraazabicyclo[5.5.2]tetradecane Manganese(II)

Chloro-2-(2-hydroxybenzyl)-5-methyl 1,5,8,12-tetraazabicyclo[6.6.2]hexadecane Manganese(II)

Chloro-10-(2-hydroxybenzyl)-4-methyl-1,4,7,10-tetraazabicyclo[5.5.2]tetradecane Manganese(II)

Chloro-5-methyl-12-(2-picolyl)-1,5,8,12-tetraazabicyclo[6.6.2]hexadecane Manganese(II) Chloride Chloro-4-methyl-10-(2-picolyl)-1,4,7,10-tetraazabicyclo[5.5.2]tetradecane Manganese(II) Chloride Dichloro-5-(2-sulphato)dodecyl-12-methyl-1,5,8,12-tetraazabicyclo[6.6.2]hexadecane Manganese(III)

Aquo-Chloro-5-(2-sulphato)dodecyl-12-methyl-1,5,8,12-tetraazabicyclo[6.6.2]hexadecane Manganese(II)

Aquo-Chloro-5-(3-sulphonopropyl)-12-methyl-1,5,8,12-tetraazabicyclo[6.6.2]hexadecane Manganese(II)

Dichloro-5-(Trimethylammoniopropyl)dodecyl-12-methyl-1,5,8,12-tetraazabicyclo[6.6.2]hexadecane Manganese(III) Chloride Dichloro-5,12-dimethyl-1,4,7,10,13-pentaazabicyclo[8.5.2]heptadecane Manganese (II)

Dichloro-14,20-dimethyl-1,10,14,20-tetraazatriyclo[8.6.6]docosa-3(8),4,6-triene Manganese (II)

Dichloro-4.11-dimethyl-1,4,7,11-tetraazabicyclo[6.5.2]pentadecane Manganese(II)

Dichloro-5,12-dimethyl-1,5,8,12-tetraazabicyclo[7.6.2]heptadecane Manganese(II)

Dichloro-5.13-dimethyl-1,5,9,13-tetraazabicyclo[7.7.2]heptadecane Manganese(II)

Dichloro-3,10-bis(butylcarboxy)-5,12-dimethyl-1,5,8,12-tetraazabicyclo[6.6.2]hexadecane Manganese(II)

Diaquo-3,10-dicarboxy-5,12-dimethyl-1,5,8,12-tetraazabicyclo[6.6.2]hexadecane Manganese(II)

Chloro-20-methyl-1,9,20,24,25-pentaaza-tetracyclo[$7.7.7.1^{3,7}.1^{11,15}$]pentacosa-3,5,7(24),11,1315(25)-hexaene manganese (II) Hexafluorophosphate Trifluoromethanesulphono-20-methyl-1,9,20,24,25-pentaaza-tetracyclo[$7.7.7.1^{3,7}.1^{11,15}$]pentacosa-3,5,7(24),11,13,15(25)-hexaene Manganese (II) trifluoromethanesulphonate Trifluoromethanesulphono-20-methyl-1,9,20,24,25-pentaazatetracyclo[$7.7.7.1^{3,7}.1^{11,15}$]pentacosa-3,5,7(24),11,13,15(25)-hexaene Iron(II) trifluoromethanesulphonate Chloro-5,12,17-trimethyl-1,5,8,12,17-pentaazabicyclo[6.6.5]nonadecane Manganese (II) hexafluorophosphate Chloro-4,10,15-trimethyl-1,4,7,10,15-pentaazabicyclo[5.5.5]heptadecane Manganese (II) hexafluorophosphate Chloro-5,12,17-trimethyl-1,5,8,12,17-pentaazabicyclo[6.6.5]nonadecane Manganese(II) chloride Chloro-4,10,15-trimethyl-1,4,7,10,15-pentaazabicyclo[5.5.5]heptadecane Manganese(IT) chloride The invention further includes the compositions which include the transition-metal complexes, preferably the Mn, Fe, Cu and Co complexes, or preferred cross-bridged macropolycyclic ligands having the formula:

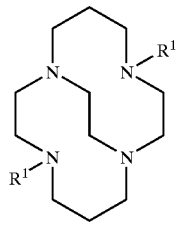

wherein in this formula "R1" is independently selected from H, and linear or branched, substituted or unsubstituted C1–C20 alkyl, alkylaryl, alkenyl or alkynyl, more preferably RI is alkyl or alkylaryl; and preferably all nitrogen atoms in the macropolycyclic rings are coordinated with the transition metal.

Also preferred are cross-bridged macropolycyclic ligands having the formula:

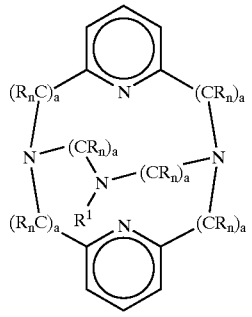

wherein in this formula:

each "n" is an Integer independently selected from 1 and 2, completing the valence of the carbon atom to which the R moieties are covalently bonded;

each "R" and "R1" is independently selected from H, alkyl, alkenyl, alkynyl, aryl, alkylaryl (e.g., benzyl), and heteroaryl, or R and/or R1 are covalently bonded to form an aromatic, heteroaromatic, cycloalkyl, or heterocycloalkyl ring, and wherein preferably all R are H and R1 are independently selected from linear or branched, substituted or unsubstituted C1–C20 alkyl, alkenyl or alkynyl;

each "a" is a integer independently selected from 2 or 3;

preferably all! nitrogen atoms in the macropolycyclic rings are coordinated with the transition metal. In terms of the present invention, even though any of such ligands are known, the invention encompasses the use of these ligands in the form of their transition-metal complexes as oxidation catalysts, or in the form of the defined catalytic systems.

In like manner, included in the definition of the preferred cross-bridged macropolycyclic ligands are those having the formula:

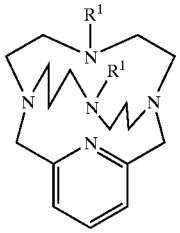

or

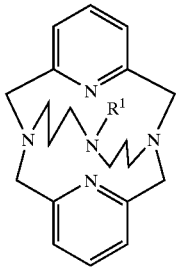

wherein in either of these formulae, "$R^1$" is independently selected from H, or, preferably, linear or branched, substituted or unsubstituted C1–C20 alkyl, alkenyl or alkynyl; and preferably all nitrogen atoms in the macropolycyclic rings are coordinated with the transition metal.

The present invention has numerous variations and alternate embodiments. Thus, in the foregoing catalytic systems, the macropolycyclic ligand can be replaced by any of the following:

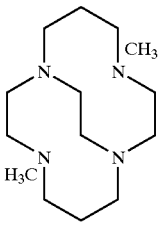

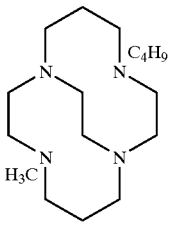

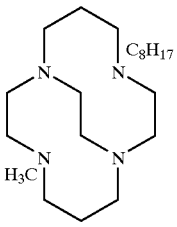

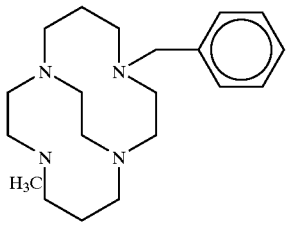

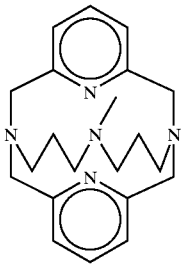

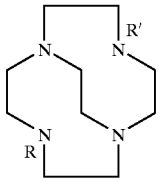

-continued

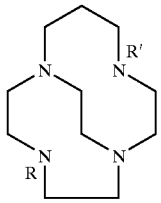

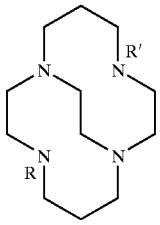

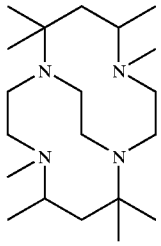

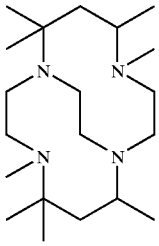

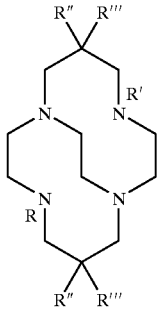

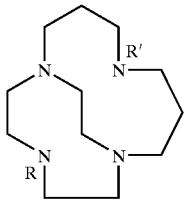

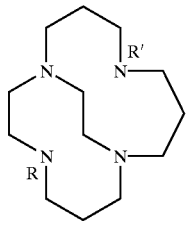

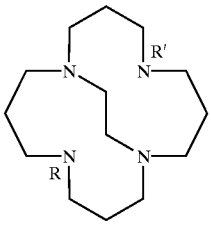

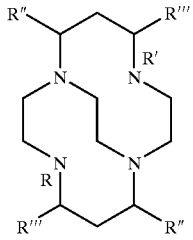

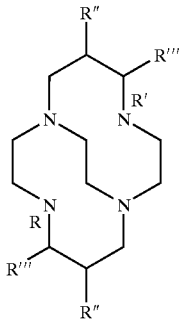

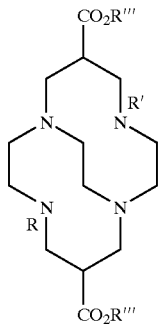

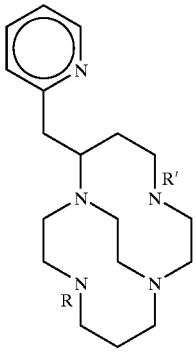

-continued

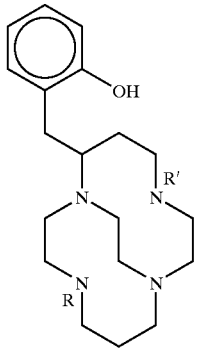

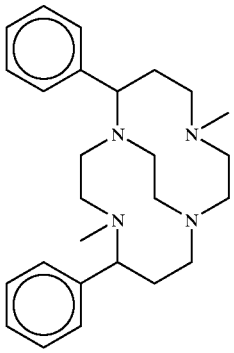

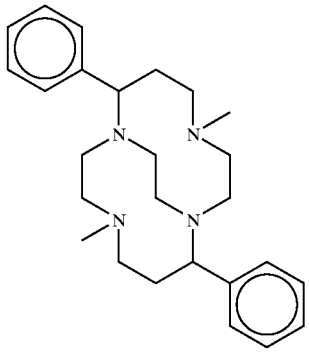

In the above, the R, R', R", R'" moieties can, for example, be methyl, ethyl or propyl. (Note that in the above formalism, the short straight strokes attached to certain N atoms are an alternate representation for a methyl group).

While the above illustrative structures involve tetra-aza derivatives (four donor nitrogen atoms), ligands and the corresponding complexes in accordance with the present invention can also be made, for example from any of the following:

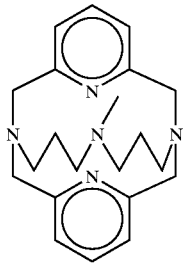

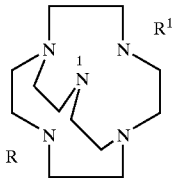

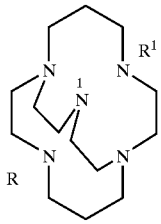

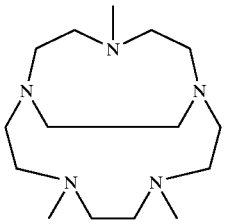

-continued

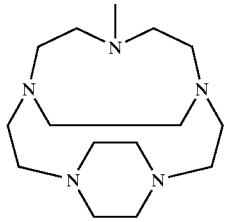

Moreover, using only a single organic macropolycycle, preferably a cross-bridged derivative of cyclam, a wide range of oxidation catalyst compounds of the invention may be prepared; numerous of these are believed to be novel chemical compounds. Preferred transition-metal catalysts of both cyclam-derived and non-cyclam-derived cross-bridged kinds are illustrated, but not limited, by the following:

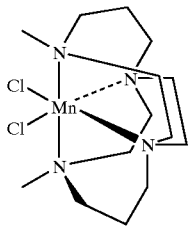

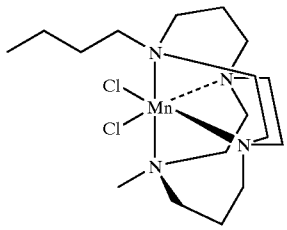

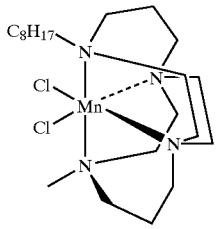

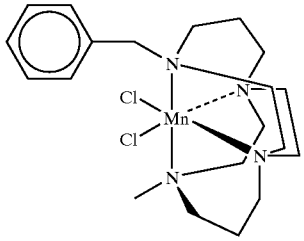

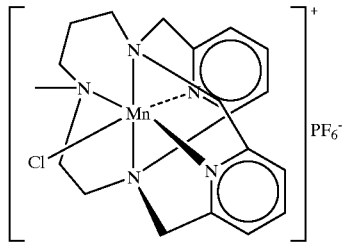

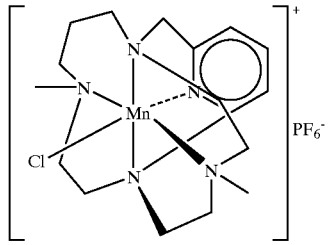

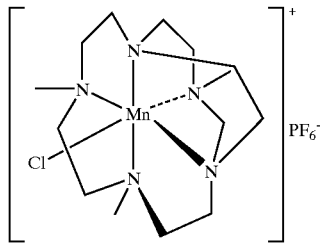

In other embodiments of the invention, transition-metal complexes, such as the Mn, Fe, Co, or Cu complexes, especially (II) and/or (III) oxidation state complexes, of the hereinabove-identified metals with any of the following ligands are also included:

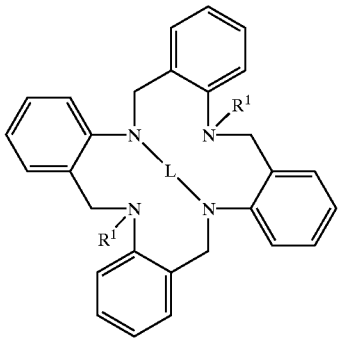

wherein R1 is independently selected from H (preferably non-H) and linear or branched, substituted or unsubstituted C1–C20 alkyl, alkenyl or alkynyl and L is any of the linking moieties given herein, for example 1.10 or 1.11;

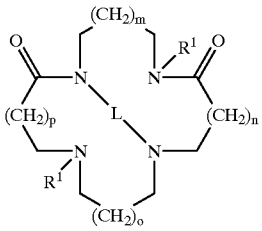

wherein R1 is as defined supra; m,n,o and p can vary independently and are integers which can be zero or a positive integer and can vary independently while respecting the provision that the sum m+n+o+p is from 0 to 8 and L is any of the linking moieties defined herein;

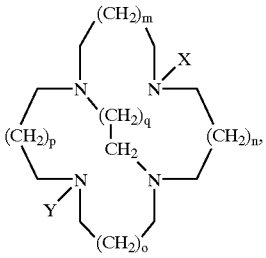

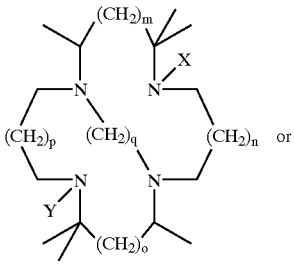

-continued

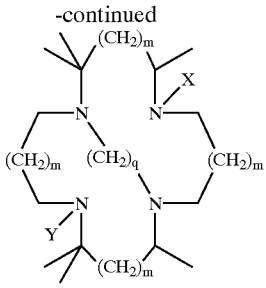

wherein X and Y can be any of the R1 defined supra, m,n,o and p are as defined supra and q is -n integer, preferably from 1 to 4; or, more generally,

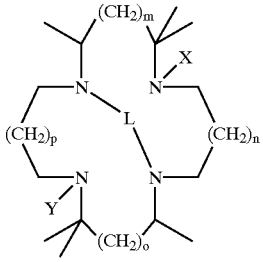

wherein L is any of the linking moieties herein, X and Y can be any of the RI defined supra, and m,n,o and p are as defined supra. Alternately, another useful ligand is:

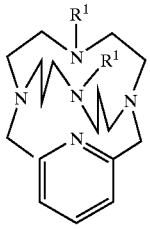

wherein RI is any of the RI moieties defined supra.

Pendant Moieties

Macropolycyclic rigid ligands and the corresponding transition-metal complexes and oxidation catalytic systems herein may also incorporate one or more pendant moieties, in addition to, or as a replacement for, R 1 moieties. Such pendant moieties are nonlimiting illustrated by any of the following:

$$-(CH_2)_n-CH_3-(CH_2)_n-C(O)NH_2$$

$$-(CH_2)_n-CN\ -(CH_2)_n-C(O)OH$$

$$-(CH_2)_n-C(O)NR_2-(CH_2)_n-OH$$

$$-(CH_2)_n-C(O)OR$$

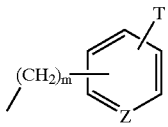

The counter ions Y in formula (Al) balance the charge z on the complex formed by the ligand L, metal M and coordinating species X. Thus, if the charge z is positive, Y may be an anion such as $RCOO^-$, $BPh_4^-$, $ClO_4^-$, $BF_4^-$, $PF_6^-$, $RSO_3^-$, $RSO_4^-$, $SO_4^{2-}$, $NO_3^-$, $F^-$, $Cl^-$, $Br^-$, or $I^-$, with R being hydrogen, optionally substituted alkyl or optionally substituted aryl. If z is negative, Y may be a common cation such as an alkali metal, alkaline earth metal or (alkyl) ammonium cation.

Suitable counter ions Y include those which give rise to the formation of storage-stable solids. Preferred counter ions for the preferred metal complexes are selected from $R^7COO^-$, $ClO_4^-$, $BF_4^-$, $PF_6^-$, $RSO_3^-$ (in particular $CF_3SO_3^-$), $RSO_4^-$, $SO_4^{2-}$, $NO_3^-$, $F^-$, $Cl^-$, $Br^-$, and $I^-$, wherein R represents hydrogen or optionally substituted phenyl, naphthyl Or $C_1$–$C_4$ alkyl.

Throughout the description and claims generic groups have been used, for example alkyl, alkoxy, aryl. Unless otherwise specified the following are preferred group restrictions that may be applied to generic groups found within compounds disclosed herein:

| | |
|---|---|
| alkyl: | C1–C6-alkyl, |
| alkenyl: | C2–C6-alkenyl, |
| cycloalkyl: | C3–C8-cycloalkyl, |
| alkoxy: | C1–C6-alkoxy, |

alkylene: selected from the group consisting of: methylene; 1,1-ethylene; 1,2-ethylene; 1,1-propylene; 1,2-propylene; 1,3-propylene; 2,2-propylene; butan-2-ol-1,4-diyl; propan-2-ol-1,3-diyl; and 1,4-butylene, aryl: selected from homoaromatic compounds having a molecular weight under 300, arylene: selected from the group consisting of: 1,2-benzene; 1,3-benzene; 1,4-benzene; 1,2-naphthalene; 1,3-naphthalene; 1,4-naphthalene; 2,3-naphthalene; phenol-2,3-diyl; phenol-2,4-diyl; phenol-2,5-diyl; and phenol-2,-6-diyl, heteroaryl: selected from the group consisting of: pyridinyl; pyrimidinyl; pyrazinyl; triazolyl, pyridazinyl; 1,3,5-triazinyl; quinolinyl; isoquinolinyl; quinoxalinyl; imidazolyl; pyrazolyl; benzimidazolyl; thiazolyl; oxazolidinyl; pyrrolyl; carbazolyl; indolyl; and isoindolyl, heteroarylene: selected from the group consisting of: pyridin-2,3-diyl; pyridin-2,4-diyl; pyridin-2,5-diyl; pyridin-2,6-diyl; pyridin-3,4-diyl; pyridin-3,5-diyl; quinolin-2,3-diyl; quinolin-2,4-diyl; quinolin-2,8-diyl; isoquinolin-1,3-diyl; isoquinolin-1,4-diyl; pyrazol-1,3-diyl; pyrazol-3,5-diyl; triazole-3,5-diyl; triazole-1,3-diyl; pyrazin-2,5-diyl; and imidazole-2,4-diyl, heterocycloalkyl: selected from the group consisting of: pyrrolinyl; pyrrolidinyl; morpholinyl; piperidinyl; piperazinyl; hexamethylene imine; and oxazolidinyl, amine: the group —$N(R)_2$ wherein each R is independently selected from: hydrogen; C1–C6-alkyl; C1–C6-alkyl-C6H5; and phenyl, wherein when both R are C1–C6-alkyl both R together may form an —NC3 to an —NC5 heterocyclic ring with any remaining alkyl chain forming an alkyl substituent to the heterocyclic ring, halogen: selected from the group consisting of: F; Cl; Br and I, sulphonate: the group —$S(O)_2OR$, wherein R is selected from: hydrogen; C1–C6-alkyl; phenyl; C1–C6-alkyl-C6H5; Li; Na; K; Cs; Mg; and Ca, sulphate: the group —$OS(O)_2OR$, wherein R is selected from: hydrogen; C1–C6-alkyl; phenyl; C1–C6-alkyl-C6H5; Li; Na; K; Cs; Mg; and Ca, sulphone: the group —$S(O)_2R$, wherein R is selected from: hydrogen; C1–C6-alkyl; phenyl; C1–C6-alkyl-C6H5 and amine (to give sulphonamide) selected from the group: —NR'2, wherein each R' is independently selected from: hydrogen; C1–C6-alkyl; C1–C6-alkyl-C6H5; and phenyl, wherein when both R' are C1–C6-alkyl both RI together may form an —NC3 to an —NC5 heterocyclic ring with any remaining alkyl chain forming an alkyl substituent to the heterocyclic ring, carboxylate derivative: the group —C(O)OR, wherein R is selected from: hydrogen, C1–C6-alkyl; phenyl; C1–C6-alkyl-C6H5, Li; Na; K; Cs; Mg; and Ca, carbonyl derivative: the group —C(O)R, wherein R is selected from: hydrogen; C1–C6-alkyl; phenyl; C1–C6-alkyl-C6H5 and amine (to give amide) selected from the group: —NR'2, wherein each R' is independently selected from: hydrogen; C1–C6-alkyl; C1–C6-alkyl-C6H5; and phenyl, wherein when both R' are C1–C6-alkyl both R' together may form an —NC3 to an —NC5 heterocyclic ring with any remaining alkyl chain forming an alkyl substituent to the heterocyclic ring, phosphonate: the group —$P(O)(OR)_2$, wherein each R is independently selected from: hydrogen; C1–C6-alkyl; phenyl; C1–C6-alkyl-C6H5; Li; Na; K; Cs; Mg; and Ca, phosphate: the group —$OP(O)(OR)_2$, wherein each R is independently selected from: hydrogen; C1–C6-alkyl; phenyl; C1–C6-alkyl-C6H5; Li; Na; K; Cs; Mg; and Ca, phosphine: the group —$P(R)_2$, wherein each R is independently selected from: hydrogen; C1–C6-alkyl; phenyl; and C1–C6-alkyl-C6H5, phosphine oxide: the group —$P(O)R_2$, wherein R is independently selected from: hydrogen; C1–C6-alkyl; phenyl; and C1–C6-alkyl-C6H5; and amine (to give phosphonamidate) selected from the group: —NR'2, wherein each R' is independently selected from: hydrogen; C1–C6-alkyl; C1–C6-alkyl-C6H5; and phenyl, wherein when both R' are C1–C6-alkyl both R' together may form an —NC3 to an —NC5 heterocyclic ring with any remaining alkyl chain forming an alkyl substituent to the heterocyclic ring.

Unless otherwise specified the following are more preferred group restrictions that may be applied to groups found within compounds disclosed herein:

| | |
|---|---|
| alkyl: | C1–C4-alkyl, |
| alkenyl: | C3–C6-alkenyl, |
| cycloalkyl: | C6–C8-cycloalkyl, |
| alkoxy: | C1–C4-alkoxy, |

alkylene: selected from the group consisting of: methylene; 1,2-ethylene; 1,3-propylene; butan-2-ol-1,4-diyl; and 1,4-butylene, aryl: selected from group consisting of: phenyl; biphenyl, naphthalenyl; anthracenyl; and phenanthrenyl, arylene: selected from the group consisting of: 1,2-benzene, 1,3-benzene, 1,4-benzene, 1,2-naphthalene, 1,4-naphthalene, 2,3-naphthalene and phenol-2,6-diyl, heteroaryl: selected from the group consisting of: pyridinyl; pyrimidinyl; quinolinyl; pyrazolyl; triazolyl; isoquinolinyl; imidazolyl; and oxazolidinyl, heteroarylene: selected from the group consisting of: pyridin-2,3-diyl; pyridin-2,4-diyl; pyridin-2,6-diyl; pyridin-3,5-diyl; quinolin-2,3-diyl; quinolin-2,4-diyl; isoquinolin-1,3-diyl; isoquinolin-1,4-diyl; pyrazol-3,5-diyl; and imidazole-2,4-diyl, heterocycloalkyl: selected from the group consisting of: pyrrolidinyl; morpholinyl; piperidinyl; and piperazinyl, amine: the group —$N(R)_2$, wherein each R is independently selected from: hydrogen; C1–C6-alkyl; and benzyl, halogen: selected from the group consisting of: F and Cl, sulphonate: the group —$S(O)_2OR$, wherein R is selected from: hydrogen; C1–C6-alkyl; Na; K; Mg; and Ca, sulphate: the group —$OS(O)_2OR$, wherein R is selected from: hydrogen; C1–C6-alkyl; Na; K; Mg; and Ca, sulphone: the group —$S(O)_2R$, wherein R is selected from: hydrogen; C1–C6-alkyl; benzyl and amine selected from the group: —NR'2, wherein each R' is independently selected from: hydrogen; C1–C6-alkyl; and benzyl, carboxylate derivative: the group —C(O)OR, wherein R is selected from hydrogen; Na; K; Mg; Ca; C1–C6-alkyl; and benzyl, carbonyl derivative: the group: —C(O)R, wherein R is selected from: hydrogen; C1–C6-alkyl; benzyl and amine selected from the group: —NR'2, wherein each R' is independently selected from: hydrogen; C1–C6-alkyl; and benzyl, phosphonate: the group —$P(O)(OR)_2$, wherein each R is independently selected from: hydrogen; C1–C6-alkyl, benzyl; Na; K; Mg; and Ca, phosphate: the group —$OP(O)(OR)_2$, wherein each R is independently selected from: hydrogen; C1–C6-alkyl; benzyl; Na; K; Mg; and Ca, phosphine: the group —$P(R)_2$, wherein each R is independently selected from: hydrogen; C1–C6-alkyl; and benzyl, phosphine oxide: the group —$P(O)R_2$, wherein R is independently selected from: hydrogen; C1–C6-alkyl; benzyl and amine selected from the group: —NR'2, wherein each R' is independently selected from: hydrogen; C1–C6-alkyl; and benzyl.

The Detergent Composition

The air bleach catalyst and may be used in a detergent composition specifically suited for stain bleaching purposes, and this constitutes a second aspect of the invention. To that extent, the composition comprises a surfactant and optionally other conventional detergent ingredients. The invention in its second aspect provides an enzymatic detergent composition which comprises from 0.1–50% by weight, based on the total detergent composition, of one or more surfactants. This surfactant system may in turn comprise 0–95% by weight of one or more anionic surfactants and 5 to 100% by weight of one or more nonionic surfactants. The surfactant system may additionally contain amphoteric or zwitterionic detergent compounds, but this in not normally desired owing to their relatively high cost. The enzymatic detergent composition according to the invention will generally be used as a dilution in water of about 0.05 to 2%.

In general, the nonionic and anionic surfactants of the surfactant system may be chosen from the surfactants described "Surface Active Agents" Vol. 1, by Schwartz & Perry, Interscience 1949, Vol. 2 by Schwartz, Perry & Berch, Interscience 1958, in the current edition of "McCutcheon's Emulsifiers and Detergents" published by Manufacturing Confectioners Company or in "Tenside-Taschenbuch", H. Stache, 2nd Edn., Carl Hauser Verlag, 1981.

Suitable nonionic detergent compounds which may be used include, in particular, the reaction products of compounds having a hydrophobic group and a reactive hydrogen atom, for example, aliphatic alcohols, acids, amides or alkyl phenols with alkylene oxides, especially ethylene oxide either alone or with propylene oxide. Specific nonionic detergent compounds are $C_6$–$C_{22}$ alkyl phenol-ethylene oxide condensates, generally 5 to 25 EO, i.e. 5 to 25 units of ethylene oxide per molecule, and the condensation products of aliphatic $C_8$–$C_{18}$ primary or secondary linear or branched alcohols with ethylene oxide, generally 5 to 40 EO.

Suitable anionic detergent compounds which may be used are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher $C_8$–$C_{18}$ alcohols, produced for example from tallow or coconut oil, sodium and potassium alkyl $C_9$–$C_{20}$ benzene sulphonates, particularly sodium linear secondary alkyl $C_{10}$–$C_{15}$ benzene sulphonates; and sodium alkyl glyceryl ether sulphates, especially those ethers of the higher alcohols derived from tallow or coconut oil and synthetic alcohols derived from petroleum. The preferred anionic detergent compounds are sodium $C_{11}$–$C_{15}$ alkyl benzene sulphonates and sodium $C_{12}$–$C_{18}$ alkyl sulphates. Also applicable are surfactants such as those described in EP-A-328 177 (Unilever), which show resistance to salting-out, the alkyl polyglycoside surfactants described in EP-A-070 074, and alkyl monoglycosides.

Preferred surfactant systems are mixtures of anionic with nonionic detergent active materials, in particular the groups and examples of anionic and nonionic surfactants pointed out in EP-A-346 995 (Unilever). Especially preferred is surfactant system that is a mixture of an alkali metal salt of a $C_{16}$–$C_{18}$ primary alcohol sulphate together with a $C_{12}$–$C_{15}$ primary alcohol 3–7 EO ethoxylate.

The nonionic detergent is preferably present in amounts greater than 10%, e.g. 25–90% by weight of the surfactant system. Anionic surfactants can be present for example in amounts in the range from about 5% to about 40% by weight of the surfactant system.

One skilled in the art will appreciate that some adventitious peroxyl species may be in the composition nevertheless it is most preferred that the bleaching composition of the present invention has less that 1%, preferably less than 0.1%, most preferably less than 0.01%, of a peroxyl species present.

The detergent composition may take any suitable physical form, such as a powder, granular composition, tablets, a paste or an anhydrous gel.

The composition may contain additional enzymes as found in WO 01/00768 A1 page 15, line 25 to page 19, line 29, the contents of which are herein incorporated by reference.

Builders, polymers and other enzymes as optional ingredients may also be present as found in WO0060045.

Suitable detergency builders as optional ingredients may also be present as found in WO0034427.

The composition of the present invention may be used for laundry cleaning, hard surface cleaning (including cleaning of lavatories, kitchen work surfaces, floors, mechanical ware washing etc.). As is generally known in the art, bleaching compositions are also employed in waste-water treatment, pulp bleaching during the manufacture of paper, leather manufacture, dye transfer inhibition, food processing, starch bleaching, sterilisation, whitening in oral hygiene preparations and/or contact lens disinfection.

In the context of the present invention, bleaching should be understood as relating generally to the decolourisation of stains or of other materials attached to or associated with a substrate. However, is envisaged that the present invention can be applied where a requirement is the removal and/or neutralisation by an oxidative bleaching reaction of malodours or other undesirable components attached to or otherwise associated with a substrate. Furthermore, in the context of the present invention bleaching is to be understood as being restricted to any bleaching mechanism or process that does not require the presence of light or activation by light.

Other Aspects

In typical washing compositions the level of the air bleach catalyst is such that the in-use level is from 1 $\mu$M to 50 mM, with preferred in-use levels for domestic laundry operations falling in the range 10 to 100 $\mu$M. Higher levels may be desired and applied in industrial bleaching processes, such as textile and paper pulp bleaching.

Preferably, the air bleaching composition of the present invention provides in an aqueous medium a pH in the range from pH 6 to 13, more preferably from pH 6 to 11, still more preferably from pH 8 to 11, and most preferably from pH 8 to 10, in Particular from pH 9 to 10.

The invention will now be further illustrated by way of the following non-limiting examples:

EXAMPLES

[(MeN4Py)FeCl]Cl

The ligand N,N-bis(pyridin-2-yl-methyl)-1,1-bis(pyridin-2-yl)-1-aminoethane (MeN4py) was prepared as described in EP 0 909 809 A2.

The ligand MeN4Py (33.7 g; 88.5 mmoles) was dissolved in 500 ml dry methanol. Small portions of $FeCl_2.4H_2O$ (0.95 eq; 16.7 g; 84.0 mmoles) were added, yielding a clear red solution. After addition, the solution was stirred for 30 minutes at room temperature, after which the methanol was removed (rotary-evaporator). The dry solid was ground and 150 ml of ethylacetate was added and the mixture was stirred until a fine red powder was obtained. This powder was washed twice with ethyl acetate, dried in the air and further dried under reduced pressure vacuum at 40° C. El. Anal. Calc. for [Fe(MeN4py)Cl]Cl.$2H_2O$ : C, 53.03; H, 5.16; N, 12.89; Cl, 13.07; Fe, 10.01%. Found C, 52.29/52.03; H, 5.05/5.03; N, 12.55/12.61; Cl, 12.73/12.69; Fe, 10.06/10.01%.

In the following experimental examples Sokalan® CP5 was used as a non acidic binder and Sokalan® CP45 as an acidic binder. Both binders were used in the form of 40% aqueous solutions. Sokalan® CP5 is the sodium salt of an acrylic acid-maleic acid copolymer manufactured by BASF having a molecular weight of about 70,000. Sokalan® CP5 is supplied either as a dry powder or as a 40% aqueous solution having a pH of approximately 8. Sokalan® CP45 is a partially neutralised polymer of an acrylic acid-maleic acid copolymer manufactured by BASF having a molecular weight of about 70,000. Sokalan® CP45 is supplied either as a dry powder or as a 40% aqueous solution having a pH of approximately 4.

Non-acidic catalyst granules were prepared by mixing Fe(MeN4py) Cl]Cl (5.23 g) with sodium sulphate (94.76 g) in a laboratory scale high shear mixer/granulator followed by addition of 15.05 g of a 40% Sokalan CP5 solution. The obtained wet granulate was dried in a laboratory scale fluid bed at air inlet temperature of about 80° C. during about 5 minutes.

Acidic catalyst granules were prepared by mixing Fe(MeN4py)Cl]Cl (5.23 g) with sodium sulphate (94.33 g) in a laboratory scale high shear mixer/granulator followed by addition of 15.67 g of a 40% Sokalan CP45 solution. The obtained wet granulate was dried in a laboratory scale fluid bed at an air inlet temperature of about 80° C. during about 5 minutes.

The acidic catalyst granules and non-acidic catalyst granules (0.06 g) were individually processed by mixing 4.5 g detergent base powder (see below) and stored in open topped bottles at 28° C. and at a relative humidity of (RH) 76% in the absense of any added peroxyl species. At periodic intervals samples were removed and their bleach activity measured. We have found that not all peroxyl activating catalysts are capable of functioning as an oxygen activation catalyst. In contrast, we have Found that most oxygen activation catalysts will function as peroxyl activating catalysts. We have found that bleaching of a BC-1 stain (tea stain) with hydrogen peroxide is a reliable assay of active catalyst. In this regard, the activity of the air bleaching composition is tested in this manner. The reason for doing this is that the bleach response of the bleach monitor (BC1—tea stain) is more reproducible than the bleach response of a tomato or curry oil stain when used as a bleach monitor in oxygen activation. We have previously established that: 1) bleach activity of Fe(MeN4py)Cl]Cl in peroxide activation mode correlates with its activity in oxygen activation mode, and 2) in the concentration range in which we test the catalyst performance, the response of the peroxyl bleaching with a BC1 testcloth is linear with catalyst concentration.

Base Detergent

| Component | Powder (%) |
|---|---|
| NaLAS | 23.0000 |
| Silicate | 6.6995 |
| STPP | 14.5000 |
| Sulphate P | 0.4165 |
| Sulphate Added | 31.4317 |
| Carbonate | 17.5000 |
| SCMC | 0.3550 |
| Cationic (40%) | 0.9426 |
| CBS slurry | 0.0653 |
| DMS slurry | 0.1160 |
| Dye | 0.0143 |
| Amilase | 0.2840 |
| Savinase 12T | 0.4735 |
| Lipolase 100T | 0.1893 |
| Impurities | 0.3804 |
| Water | 3.5820 |
| Sub-Total | 68.5183 |
| Total | 100.0000 |

Washing Experiments

Test cloths were washed for 30 minutes (100 rpm) in a tergotometer at 40° C. using a solution of 1.25 g of sodium percarbonate in 1 L of demin. water. After washing the test cloth were wrung out by hand and given a single rinse by immersion in tap water at a liquor to cloth ratio of 100:1. When dry the reflectance of the monitor cloths was measured using a Hunterlab Ultrascan Xe.

Two controls were used both with a base detergent as defined above. One to represent 0% air bleach catalyst together with 1.25 g sodium percarbonate. Another to represent 100% air bleach catalyst together with 1.25 g sodium percarbonate.

The bleaching results obtained from test compositions were compared to a control that was equivalent to the amount of air bleaching catalyst present in the compositions as initially made and added in the wash experiment.

After washing, the cloths are left to dry in the dark overnight. The reflection measurements are then taking and ΔE recorded (with respect to the white tile measurement). From these numbers it is then possible to calculate the % bleach activity by comparing the storage sample results with the 0% and 100% controls using the following equation:

$$[\Delta E\ (0\%)-\Delta E\ (X)/\Delta E\ (0\%)-\Delta E(100\%)]\times 100,$$ wherein X=storage sample.

Table 1 below shows the activity in terms of comparison with the activity of a freshly prepared formulation.

TABLE 1

| Time (weeks) | % Bleach Activity Neutral Granule | % Bleach Activity Acid Granule |
|---|---|---|
| 0 | 96 | 103 |
| 1 | 103 | 108 |
| 2 | 92 | 103 |
| 4 | 64 | 107 |
| 6 | 36 | 100 |
| 8 | — | 98 |

The results in Table 1 show a substantial advantage provided by the present invention to the stability of the air bleaching composition by use of an acidic component

What is claimed is:

1. An air bleaching composition having improved storage properties, for bleaching a substrate in an aqueous solution, comprising:

particles of an air bleaching catalyst in the form of a granule comprising a transition metal complex;

and, a component selected from the group consisting of: a cogranulent with said granule, a binder of said granule, and a coating of said granule, the component being an acidic component which is a water soluble acidic polymer, said polymer having a water solubility greater than 5 g/l at 20° C., a molecular weight of from 1000 to 250000, and wherein a 1% solution of said polymer has a pH of less than 7.

2. An air bleaching composition according to claim 1, wherein the particles of the air bleaching catalyst are in the form of pregranules comprising the air bleaching catalyst and a neutral water soluble material.

3. An air bleaching composition according to claim 1, wherein the water soluble acidic polymer is a polymer formed from the polymerisation of an unsaturated compound containing a carboxylic acid.

4. An air bleaching composition according to claim 1, wherein the water soluble acidic polymer is a copolymer of acrylic acid and maleic acid.

5. An air bleaching composition according to claim 1, wherein the air bleaching catalyst is a transition metal complex of a ligand selected from:(N,N-bis(pyridin-2-yl-methyl)-1,1-bis(pyridin-2-yl)-1-aminoethane and 5,12-dimethyl-1,5,8,12-tetraazabicyclo[6.6.2]hexadecane.

6. An air bleaching composition according to claim 5, wherein the transition metal complex is selected from: an iron complex of (N,N-bis(pyridin-2-yl-methyl)-1,1-bis (pyridin-2-yl)-1-aminoethane and a manganese complex of 5,12-di methyl-1,5,8,12-tetraazabicyclo[6.6.2]hexadecane.

7. An air bleaching composition according claim 1, wherein the air bleaching composition has been processed to form a tablet.

8. An air bleaching composition according to claim 1, wherein in an aqueous medium at least 10% of any bleaching of the substrate being effected by oxygen sourced from to air.

9. A process for the preparation of an air leaching composition the air bleaching composition having improved storage properties comprising the step of:

granulating an air bleaching catalyst with a component selected from the group consisting of: binder, cogranulent, and a coating, the component selected being a water soluble acidic polymer, said polymer having a water solubility greater than 5 g/l at 20° C., a molecular weight of from 1000 to 250000, and wherein a 1% solution of said polymer has a pH of less than 7.

10. A process for the preparation of an air bleaching composition according to claim 9, wherein the air bleaching catalyst is a particle comprising a transition metal catalyst and a neutral water soluble material.

11. A process for the preparation of an air bleaching composition according to claim 9, wherein the neutral water soluble material is selected from sodium sulphate and sodium chloride.

12. An air bleaching composition according to claim 1 wherein in an aqueous medium at least 50% of any bleaching of the substrate is effected by oxygen sourced from the air.

13. An air bleaching composition according to claim 1, wherein in an aqueous medium at least 90% of any bleaching of the substrate is effected by oxygen sourced from the air.

* * * * *